US006956557B2

(12) United States Patent
Machida et al.

(10) Patent No.: US 6,956,557 B2
(45) Date of Patent: Oct. 18, 2005

(54) IMAGE DISPLAY DEVICE

(75) Inventors: Yoshinori Machida, Ashigarakami-gun (JP); Takeshi Matsunaga, Ashigarakami-gun (JP); Kiyoshi Shigehiro, Ashigarakami-gun (JP); Yoshiro Yamaguchi, Ashigarakami-gun (JP); Yasufumi Suwabe, Ashigarakami-gun (JP); Motohiko Sakamaki, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 278 days.

(21) Appl. No.: 10/124,380

(22) Filed: Apr. 18, 2002

(65) Prior Publication Data

US 2003/0063076 A1 Apr. 3, 2003

(30) Foreign Application Priority Data

Sep. 28, 2001 (JP) ..... 2001-304460

(51) Int. Cl.[7] ..... G09G 3/34
(52) U.S. Cl. ..... 345/107; 345/85; 359/296
(58) Field of Search ..... 345/107, 105, 345/30, 55, 84–87; 359/296, 297, 290; 204/600

(56) References Cited

U.S. PATENT DOCUMENTS 4,806,443 A 2/1989 Yanus et al.
6,333,754 B1 * 12/2001 Oba et al. ..... 347/112
6,407,763 B1 * 6/2002 Yamaguchi et al. ..... 347/112
6,636,186 B1 * 10/2003 Yamaguchi et al. ..... 345/31
6,639,580 B1 * 10/2003 Kishi et al. ..... 345/107
6,693,621 B1 * 2/2004 Hayakawa et al. ..... 345/107
6,800,368 B2 * 10/2004 Shigehiro et al. ..... 428/403

FOREIGN PATENT DOCUMENTS

JP A 10-3177 1/1998
JP A 2000-347483 12/2000
JP A 2001-33833 2/2001

OTHER PUBLICATIONS

Gugrae-Jo et al., "New Toner Display Device (I)", Japan Hardcopy articles, pp. 249-252, 1999.
Gugrae-Jo et al., "New Toner Display Device (II)", Japan Hardcopy Fall preliminary articles, pp. 10-13, 1999.

* cited by examiner

*Primary Examiner*—Regina Liang
*Assistant Examiner*—Jennifer T. Nguyen
(74) *Attorney, Agent, or Firm*—Oliff & Berridge, PLC

(57) ABSTRACT

The present invention is for providing an image display device capable of preventing deterioration of display sharpness and contrast, and capable of improving display quality. An image display medium has a display substrate, having a first electrode, disposed on an image display surface side, a rear substrate having a plurality of second electrodes facing the display substrate, and two kinds of particle groups having different colors and charge characteristics sealed between the display substrate and the rear substrate movably between the first electrode and the second electrodes by an electric field. Before application of a display drive voltage for executing the image display, a voltage is applied to the image display medium by a voltage applying component so as to generate an electric field for moving the particle groups between the second electrodes to adjacent the second electrodes.

20 Claims, 21 Drawing Sheets

IMAGE DISPLAY DEVICE

BACKGROUND OF THE INVENTION

1. Field of the Invention

The present invention relates to an image display device. More specifically, it relates to an image display device for repeatedly displaying images by driving colored particles sealed between a transparent display substrate and a rear substrate by an electric field.

2. Description of the Related Art

Conventionally, as an image displaying medium (display device) capable of being rewritten repeatedly, a twisting ball display (two-color-painted particle rotating display), an electrophoresis display medium, a magnetophoresis display medium, a thermal rewritable display medium, a liquid crystal display medium having a memory property, and the like have been proposed.

Among these image display media, although the thermal rewritable display medium, the liquid crystal display medium having a memory property, and the like have excellent image memory property, they cannot provide a background with sufficient whiteness like paper, and thus the contrast between an image part and a non-image part is small when displaying an image, so that it has been difficult to display a sharp image.

Moreover, the image media utilizing electrophoresis and magnetophoresis have colored particles movable by, for example, an electric field or a magnetic field dispersed in a white liquid. For imaging, the colored particles are adhered on a display surface so as to display the color of the colored particles in the image part, and the colored particles are eliminated from the display surface so as to display the white color of the white liquid in the non-image part. Since the colored particle movement is not generated except by functioning of the electric field or magnetic field, the display memory property can be provided. However, according to these methods, although the white display property of the white liquid is excellent, when displaying the color of the colored particles, since the white liquid enters into gaps among the colored particles, the display density is lowered. Therefore, the contrast between the display part and the non-display part is lowered, so it has been difficult to obtain a sharp display. Moreover, since the white liquid is sealed in these display media, there is a risk of leakage of the white liquid from the display media when the display media are detached from image display devices and handled in a rough manner like paper.

The twisting ball display is a method for display by rotating spherical particles, with one half-surface painted in white and the other half-surface painted in black, by the function of an electric field, for example, functioning the electric field such that the black surface is on a display surface side in the image part and the white surface is on the display surface side in the non-image part. According to this, since rotation driving of the particles is not generated except by the function of the electric field, the display memory property can be provided. Moreover, in the display medium, since an oil is present only in cavities in the vicinity of the particles but the display medium comprises mostly a solid, the display medium can be formed as a sheet relatively easily. However, according to this method, it is difficult to completely rotate the particles and the contrast is deteriorated for particles without complete rotation, so a sharp display image is hard to form. Furthermore, even in the case the half spherical surfaces painted in white can completely align on the display side, it is difficult to provide a white display like paper, due to light absorption and light scattering in the cavities, and consequently it has been difficult to obtain a sharp display image. Moreover, since the particle size is required to be smaller than a pixel size, a problem is involved in that fine spherical particles painted in colors need to be produced for a high resolution display, so a highly sophisticated production technique is required.

Moreover, recently, as a completely solid-type display medium, several display media with colored particles, such as a powdery toner, sealed between a pair of substrates (for example, the display media disclosed in *Japan hardcopy,* '99 articles, pp. 249–252, *Japan Hardcopy*, '99, Fall preliminary articles, pp. 10–13, and Japanese Patent Laid-Open (JP-A) No. 2000-347483, and a display medium disclosed in JP-A No. 2001-33833 have been proposed.

These have a configuration comprising a conductive colored toner (such as a black toner) and an insulating colored particle (such as a white color particle) sealed between a transparent display substrate and a rear substrate facing thereto with a minute gap. An electrode is formed on the display substrate and the rear substrate, and the inner surface of each substrate is coated with a charge transporting material for transporting only charge of one polarity (for example, positive holes).

When a voltage is applied between these substrates, positive holes are injected into only the conductive black toner, and the black toner is charged positively so as to move between the substrates, pushing past the white particles, according to the electric field formed between the substrates. Here, where the black toner is moved to the display substrate side, black display is executed, and where the black toner is moved to the rear substrate side, white display is executed by the white particles. Therefore, by applying a voltage between the substrates for moving the black toner according to the image information of the image to be displayed, black-and-white image display can be carried out.

According to the display medium using these colored particles, since the particles are not moved as long as an electric field is not applied, the display memory property can be provided. Moreover, since the display medium only contains solids, a problem of liquid leakage cannot occur. Furthermore, a high contrast image display can be provided by two kinds of colored particles (for example, the white particles and black particles).

Moreover, as a display medium proposed by the present inventors, one disclosed in Japanese Patent Application No. 2000-165138 can be presented. This has a configuration comprising two kinds of colored particle groups having different colors and charge characteristics sealed between a transparent display substrate and a rear substrate, with the two kinds of colored particle groups charged with opposite polarities. Then, by operating an electric field between the display substrate and the rear substrate, the two kinds of colored particle groups are moved independently to the different substrate sides for executing the display. According to the display medium, by applying a voltage between the substrates according to image information, a high contrast, sharp image display can be executed.

Furthermore, since the display medium has a characteristic of not providing the image display until a certain applied voltage (threshold voltage) is applied, a simple matrix drive can be adopted for driving the particles, and thus a low cost for a driving controller can be achieved.

However, in the above-mentioned display medium disclosed in Japanese Patent Application No. 2000-165138, when a simple matrix drive with linear electrodes provided at the display substrate and the rear substrate is used, since the particles are moved along the spread of the electric field generated between the substrates, the particles cannot be moved perpendicularly with respect to the substrates.

In particular, when a display drive voltage is applied such that a potential difference is generated between the electrodes adjacent to the linear electrodes, since a distance between adjacent electrodes is small compared to the distance between the substrates facing each other, a strong electric field (an edge electric field) is formed between the adjacent electrodes, so the colored particles in the vicinity of the adjacent electrodes are moved and spread out by the edge electric field. For example, according to results of experiments by the present inventors and others, if the distance between the electrodes facing each other is 200 $\mu$m, the image edge part is expanded by about 100 $\mu$m to 150 $\mu$m. When an image with a low resolution of about several tens of dpi (dots per inch), this is in the degree of having image edge parts slightly blurred, and thus does not provide a significant influence visibly. However, when an image with a high resolution exceeding 100 dpi, blurring and distortion of the image are conspicuous and drastically deteriorate the display quality.

Moreover, in the case the display drive voltage is constant, since the number of colored particles moved from the rear substrate side so as to be adhered on the display substrate is substantially fixed, if the particles are moved in a spread manner, then the particle density per unit area in the display part is smaller and the image density is lowered. When an image with a low resolution of several tens of dpi or less, this is again in the degree of having the image edge parts slightly blurred, and does not provide a significant influence visibly. However, when an image of a high resolution exceeding 100 dpi, density deterioration of a dot image, line image, character image, or the like remarkably deteriorates the display quality.

Accordingly, although a good image with high contrast and without conspicuous particle spread can be obtained when a low resolution is used, a problem is involved of thickening of a line image along the linear electrodes formed on the rear substrate, and the line density deterioration becomes remarkable when a higher resolution is used, so as to deteriorate the display quality.

Similarly, when forming a single electrode on the entire surface of the display substrate and forming pixel electrodes corresponding to one pixel per pixel on the rear substrate for adopting an active drive, a good image with a high contrast can be obtained for a display medium of low resolution. However, if the resolution of the display medium is higher, the particles cannot move perpendicularly with respect to a selected pixel electrode, and thus a problem is involved in that blurring and density deterioration of display dots become conspicuous, so as to deteriorate the display quality.

SUMMARY OF THE INVENTION

The present invention has been achieved in view of the above-mentioned problems, and an object thereof is to provide an image display device capable of preventing deterioration of display sharpness and display contrast even when displaying an image of high resolution, and capable of preventing a deterioration of display quality.

In order to achieve the above-mentioned object, a first aspect of the present invention provides an image display device including: an image display medium with an image display surface, the image display medium including a display substrate at the image display surface side, the display substrate including a first electrode, a rear substrate facing the display substrate, the rear substrate including a plane surface and a plurality of second electrodes arranged on the plane surface at predetermined intervals, and at least two kinds of particles including different colors and charge characteristics, the particles being sealed between the display substrate and the rear substrate, and being movable between the first electrode and the second electrodes when an electric field is generated between the first electrode and the second electrodes by application of a display drive voltage for executing image display; and a voltage applying component which, before the application of the display drive voltage, applies voltage so as to generate an electric field capable of moving particles that are disposed between adjacent the second electrodes.

According to the image display device of the first aspect, the colored particles are sealed between the display substrate and the rear substrate, and the electric field is formed between the electrodes facing each other by the voltage applying component applying the display drive voltage for displaying an image to the electrodes formed on the substrates. The charged colored particles are moved by the electric field so as to form a desired image on the display substrate. At this time, if the display drive voltage is applied by the voltage applying component immediately, the colored particles are moved in a spreading manner from the rear substrate side to the display substrate side due to spreading of the electric field formed between the display substrate and the rear substrate. The display substrate, the rear substrate and the electrodes can be flexible.

Therefore, a voltage is preliminarily applied by the voltage applying component such that an electric field can move those of the particles that are between adjacent electrodes. Thus, an arrangement state of at least the colored particles held on the rear substrate can be controlled before execution of the image display. In particular, the particles in the vicinity of the adjacent electrodes corresponding to an image edge part, at which a particularly strong edge electric field will be generated, can be removed and moved preliminarily. When the display drive voltage for executing the image display is applied to the electrode groups formed on the pair of substrates, spreading of the image by edge electric fields can be reduced.

Moreover, there are two ways for moving and eliminating the colored particles in the vicinity between the adjacent electrodes: a method of moving the particles from the electrode corresponding to the pixel (area) for executing the image display (an electrode that applies an image writing signal) to the electrode corresponding to the pixel (area) for not executing the image display (an electrode that does not execute image writing); and conversely, a method of moving the particles from the pixel (area) for not executing the image display to the pixel (area) for executing the image display.

Particularly in the case of the latter method of moving the particles from the area corresponding to the non-image part to the area corresponding to the image part, since an effect of preliminarily collecting the colored particles from the vicinity between the adjacent electrodes onto the electrode for executing the image writing can be provided, an effect of increasing the number of particles contributing to the display can also be provided, and thus the image density can be consequently improved. Moreover, at the time of moving the particles between the adjacent electrodes, the particles can easily be peeled off from the substrates by a function of collisions between the particles; that is, a state for easy moving by the display electric field to be applied immediately thereafter can be provided, and thus the image density can be consequently improved.

A second aspect of the present invention provides the image display device of the first aspect, wherein the first electrode of the image display medium comprises an electrode group including a plurality of substantially parallel linear electrodes respectively corresponding to one of rows and columns, the plurality of second electrodes comprises an electrode group including a plurality of substantially parallel linear electrodes respectively corresponding to the other of rows and columns, the first electrodes and the second electrodes are arranged in a simple matrix pattern so as to intersect each other in plan view, and the voltage applying component applies the voltage before the application of the display drive voltage so as to generate an electric field capable of moving particles that are disposed between the lines of the second electrodes.

The image display device according to the second aspect is adopted for an image display device for executing the image display by the so-called simple matrix driving method. According to simple matrix driving, since the electric field formed between the display substrate and the rear substrate is centered on the image without spreading in the edge part of the image displayed along the linear electrodes formed on the display substrate side, spreading of the particles can hardly be generated. However, since the electric field is spread in the linear electrode direction formed on the display substrate in the edge part of the image along the linear electrodes formed on the rear substrate, the colored particles are spread at the time of moving between the display substrate and the rear substrate. In particular, if the distance between the adjacent electrodes is small, as mentioned above, the edge electric field becomes extremely large and the influence thereof is significant.

Therefore, according to the image display device of the second aspect, the arrangement condition of the colored particles adhered on the rear substrate can be controlled before application of the display drive voltage for executing the image display, by the voltage applying component applying a voltage to the desired linear electrodes before executing the image writing of the rear substrate, so as to generate an electric field to move the particle groups between the linear electrodes, and thus cause movement of the particles relative to the adjacent linear electrodes that will not execute image writing. Therefore, by preliminarily moving the particles between the electrodes in the vicinity of the electrode edge part, spreading of the particles by the edge electric field can be reduced.

Here, if the colored particles are simultaneously moved between the linear electrodes facing each other, that is, between the substrates, the display quality will be deteriorated due to generation of griminess and image disturbance. Thus, it is necessary that the voltage applied at this time is a voltage that will not move the particles between the linear electrodes facing each other. In this point, since the distance between the adjacent electrodes is sufficiently small compared to the distance between the substrates facing each other, an electric field causing movement of the colored particles between the adjacent electrodes can be formed sufficiently even with a voltage too small to cause movement of the colored particles between the substrates.

A third aspect of the present invention provides the image display device according to the first aspect, wherein at least the plurality of second electrodes of the image display medium includes an electrode group forming an active matrix pattern, the electrode group including a plurality of electrodes corresponding to pixels of the active matrix pattern, and the voltage applying component applies the voltage before the application of the display drive voltage so as to generate an electric field capable of moving particles that are disposed between the individual electrodes forming the electrode group.

The image display device of the third aspect is usable in an image forming device to be driven by the so-called active matrix driving method and the highly accurate segment driving method. Since it is difficult to form a minute electrode or circuit pattern on the display substrate side, which requires transparency, for these methods, in general, the first electrode formed on the display substrate is provided as a uniform electrode (plane electrode) and the second electrodes on the rear substrate are formed corresponding to the pixels or a desired image. Therefore, the electric field formed between the first electrode and the second electrodes is spread so that the particles are moved while spreading. In particular, since the edge electric field becomes extremely large when the distance between the adjacent pixel electrodes is small, the influence thereof is significant, so that blurring or density deterioration of dot images is generated when providing a high resolution.

Therefore, according to the image display device of the third aspect, the first or second electrodes are provided as a plurality of electrode groups, provided corresponding to pixels, and a voltage that moves the particles between the electrodes (for example, a voltage that moves the particles between a pixel electrode that executes image display and a pixel electrode that does not execute image display) is applied preliminarily by the voltage applying component before application of the display drive voltage. Thus, the arrangement state of the colored particles adhered on the rear substrate can be controlled before executing the image display. Therefore, by preliminarily moving the particles between the pixel electrodes in the vicinity of the edge part of the image, spreading of the particles by the edge electric field can be reduced.

At this time, if the particles are also moved between the substrates facing each other, griminess or image disturbance will be generated, deteriorating the display quality, and thus the voltage to be applied at this time needs to be a voltage that does not move the particles between the electrodes facing each other. In this point, as mentioned above, since the distance between the adjacent pixel electrodes is sufficiently small compared to the distance between the substrates, even a voltage that will not move the colored particles between the substrates can form an electric field that causes sufficient movement of the colored particles between the adjacent electrodes.

A fourth aspect of the present invention provides the image display devices according to the first to third aspects, wherein the voltage applying component applies the voltage before the application of the display drive voltage to the second electrodes so as to generate an electric field capable of moving particles at the rear substrate in directions from an electrode corresponding to a pixel that executes the image display towards an electrode adjacent thereto. That is, it is also possible to apply a voltage so as to generate an electric field that moves the particles on the rear substrate from the end part of an electrode corresponding to a pixel for executing the image display to an electrode adjacent to that electrode.

According to the image display device according to the fourth aspect, before application of the display drive voltage, the voltage applying component applies a voltage to the second electrodes so as to generate an electric field that moves the particles on the rear substrate from the electrode corresponding to the pixel for executing the image display to an electrode adjacent thereto. Thus, for example, in an image display medium comprising so-called simple matrix pattern electrodes, since the colored particles at the edge parts of the desired linear electrode on the rear substrate and between the linear electrodes can be moved preliminarily toward the adjacent linear electrode, the colored particles to be spreadingly moved by the edge electric field can be reduced at the time of applying the display drive voltage for executing the image display can be reduced. Thus, line thickening can be reduced. Moreover, also in an image display medium comprising a so-called active matrix pattern electrode, since the colored particles in the vicinity between electrodes of the rear substrate corresponding to pixels corresponding to the edge part of the image can be preliminarily moved towards adjacent electrodes corresponding to pixels that will not execute the image display, the colored particles that will be spreadingly moved by the edge electric field at the time of applying the voltage for executing the image display can be reduced. Thus, spreading of the pixel can be reduced.

A fifth aspect of the present invention provides the image display devices according to the first to third aspects, wherein the voltage applying component applies the voltage before the application of the display drive voltage to the second electrodes so as to generate an electric field capable of moving particles at the rear substrate in directions towards an electrode corresponding to a pixel that executes the image display from an electrode adjacent thereto. That is, it is also possible to apply a voltage so as to generate an electric field that moves the particles on the rear substrate to an electrode corresponding to a pixel for executing the image display from the end part of an electrode adjacent thereto.

According to the image display device of the fifth embodiment, before application of the display drive voltage, the voltage applying component applies a voltage to the second electrodes so as to generate an electric field that moves the particles on the rear substrate to the electrode corresponding to the pixel for executing the image display from the electrode adjacent thereto. Thus, for example, in an image display medium comprising a so-called simple matrix pattern electrode, since the colored particles in the edge part of the desired linear electrode of the rear substrate and between the linear electrodes can be preliminarily moved to the linear electrode for writing an image, the colored particles spreadingly moved by the edge electric field at the time of applying the display drive voltage for executing the image display can be reduced. Thus, line thickening can be reduced.

Moreover, since the particles in the vicinity of the linear electrode can be collected preliminarily on the linear electrode for writing the image, the number of particles contributing to the display can be increased. Thus, deterioration of the image density can be prevented. Moreover, the particles can easily be peeled off from the substrate by the function of collisions between the particles at the time of moving the particles between the adjacent electrodes. That is, the particles can be in a state easily movable by the display driving electric field to be applied immediately thereafter, and consequently the image density can be improved.

Furthermore, in an image display medium comprising a so-called active matrix pattern electrode, since the colored particles in the vicinity between electrodes of the rear substrate corresponding to pixels corresponding to the edge part of the image can be moved preliminarily to the pixel electrodes for writing the image, the colored particles spreadingly moved by the edge electric field at the time of applying the voltage for executing the image display can be reduced. Thus, spreading of the pixels can be reduced.

Moreover, since the particles in the vicinity between the pixel electrodes can be preliminarily collected on the electrodes corresponding to the pixels for executing the image display, the particles contributing to the display can be increased, so that deterioration of the image density can be prevented. Moreover, at the time of moving the particles between the adjacent electrodes, the particles can easily be peeled off from the substrate by the function of collisions between the particles, that is, the particles can be put into a state easily movable by the display drive electric field to be applied immediately thereafter, and consequently the image density can be improved.

A sixth aspect of the present invention provides the image display device according to the first to fifth aspects, wherein the voltage applying component applies the display drive voltage for executing image display a plurality of times.

According to the image display device of the sixth aspect, the voltage applying component applies the display drive voltage for executing the image display a plurality of times after applying the voltage to generate the electric field that moves the particle groups between the adjacent second electrodes. Due to limitations of costs of the driving circuit or of values of the applied voltages derived from the adopted driving method, the colored particles may not be moved sufficiently only by application of the display drive voltage one time (one cycle). In this case, by applying the display drive voltage a plurality of times, particles that are not moved by the first display drive voltage application can be moved, thus improving the image density. Here, by always preliminarily moving and eliminating the colored particles adhered in the vicinities between the adjacent electrodes of the rear substrate corresponding to the image edge part, spreading of the particles by the edge electric field can be reduced, and spreading of the image by the plurality of drive cycles can be prevented.

It is possible to apply a voltage so as to generate a potential difference that moves the particles between the adjacent electrodes to the electrode group formed on the rear substrate only one time, for moving and eliminating the particles in the edge part, and thereafter apply the display drive voltage for executing the image display to the electrode group formed on the pair of the substrates the plurality of times. However, a greater effect can be obtained by moving and eliminating the particles in the edge part for each cycle.

A seventh aspect of the present invention provides the image display device according to the first to fourth, and sixth aspects, wherein the voltage that generates an electric field capable of moving particles that are disposed between adjacent the second electrodes before the application of the display drive voltage to the second electrodes comprises a voltage value substantially the same as a voltage value of the display drive voltage.

According to the image display device of the seventh aspect, the voltage applied to generate the electric field that moves the particle groups between the adjacent second electrodes before application of the display drive voltage has the same voltage value as that of the display drive voltage. Thus, for example, in an image display medium comprising the so-called simple matrix pattern electrode of the second aspect, by simply making the timing for applying the voltage to the linear electrode group formed on the rear substrate earlier than the timing for applying the voltage to the linear electrode group formed on the display substrate, the image display device according to the fourth aspect can be realized.

Therefore, since this can be realized simply by using a common simple matrix driving circuit as is, and changing the timing of the drive voltage to be applied to the linear electrode groups formed on the display substrate and the rear substrate, a cost increase accompanying the driving circuit change will not be generated.

An eighth aspect of the present invention provides an image display device including: an image display medium with an image display surface, the image display medium including a display substrate at the image display surface side, the display substrate including a first electrode, a rear substrate facing the display substrate, the rear substrate including a plane surface and a plurality of second electrodes arranged on the plane surface at predetermined intervals, and at least two kinds of particles including different colors and charge characteristics, the particles being sealed between the display substrate and the rear substrate, and being movable between the first electrode and the second electrodes when an electric field is generated between the first electrode and the second electrodes; and a voltage applying component which applies a voltage to the second electrodes so as to generate an electric field capable of moving particles at the rear substrate in directions from an electrode corresponding to a pixel that executes image display substantially only towards an electrode adjacent thereto, and thereafter applies a display drive voltage for executing the image display to the first and second electrodes.

A ninth aspect of the present invention provides an image display device including: an image display medium with an image display surface, the image display medium including a display substrate at the image display surface side, the display substrate including a first electrode, a rear substrate facing the display substrate, the rear substrate including a plane surface and a plurality of second electrodes arranged on the plane surface at predetermined intervals, and at least two kinds of particles including different colors and charge characteristics, the particles being sealed between the display substrate and the rear substrate, and being movable between the first electrode and the second electrodes when an electric field is generated between the first electrode and the second electrodes; and a voltage applying component which applies a voltage to the second electrodes so as to generate an electric field capable of moving particles at the rear substrate in directions substantially only towards an electrode corresponding to a pixel that executes image display from an electrode adjacent thereto, and thereafter applies a display drive voltage for executing the image display to the first and second electrodes.

DESCRIPTION OF THE PREFERRED EMBODIMENTS

Figure 1:
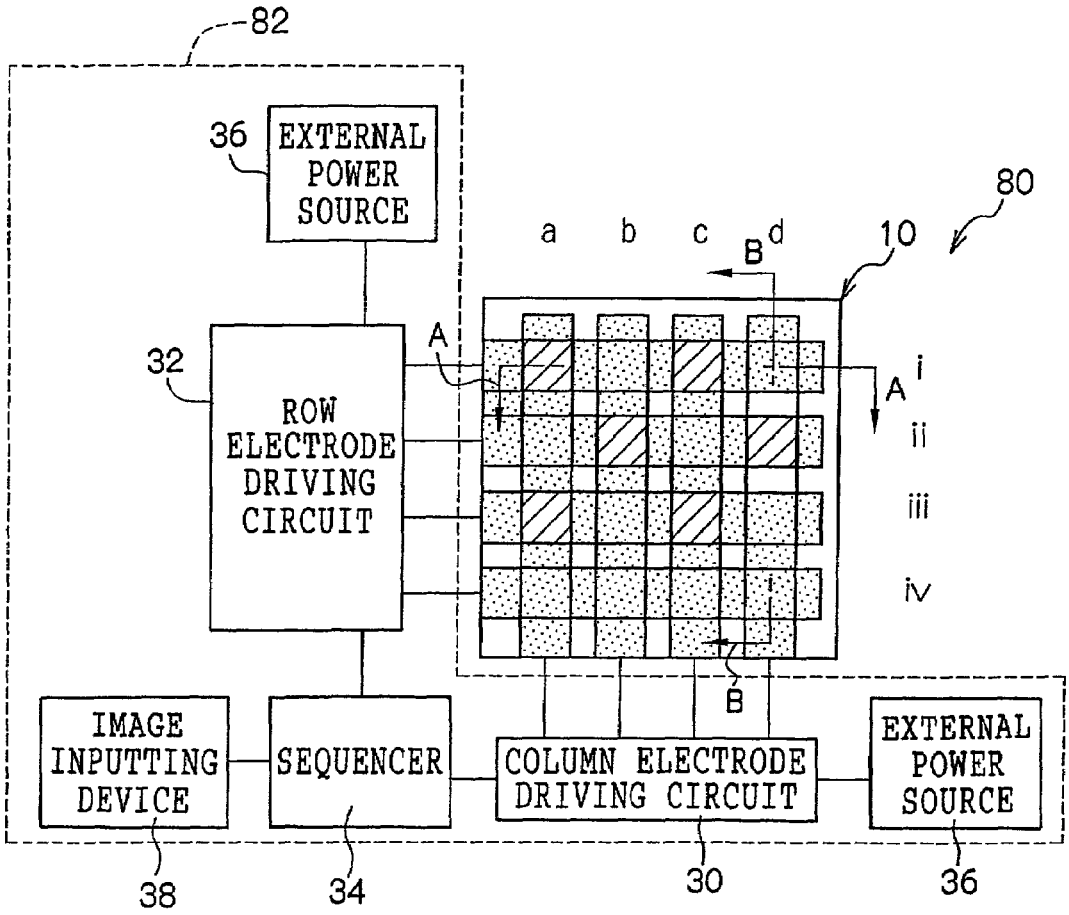
FIG. 1 is an explanatory diagram of an image display device of a simple matrix driving method according to a first embodiment of the present invention.

Hereinafter, embodiments of the present invention will be explained in detail.

(First Embodiment)

FIGS. 1 to 3B show an image display medium 10 according to this embodiment. As shown in FIGS. 1 to 3B, an image display device 80 comprises the image display medium 10 and a driving device 82 for driving the image display medium 10. The image display medium 10 comprises a transparent display substrate 12 disposed on an image display side, and a rear substrate 14 facing the display substrate 12 with a predetermined gap provided therebetween.

Figure 3A:
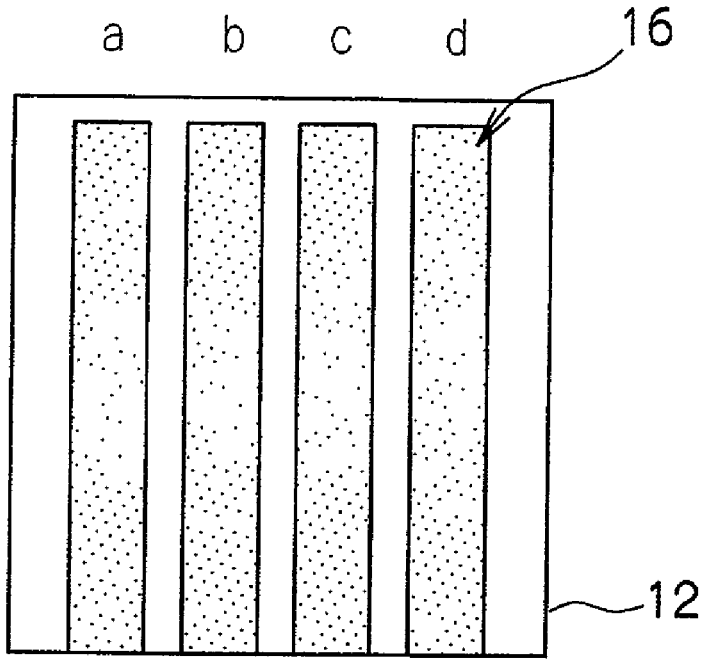
FIG. 3A is a front view of a display substrate of the image display medium according to the first embodiment of the present invention.
Figure 3B:
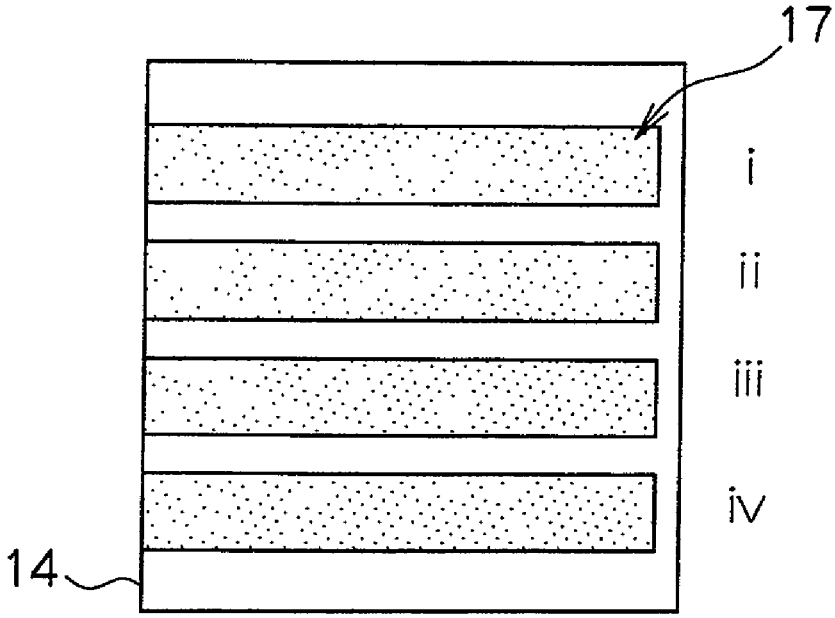
FIG. 3B is a front view of a rear substrate of the image display medium according to the first embodiment of the present invention.

The image display medium 10 is to be driven by the so-called simple matrix driving method. As shown in FIGS. 3A and 3B, a plurality of linear electrodes (column electrodes) 16 (hereinafter referred to as "column electrodes") are provided on the surface of the display substrate 12 facing the rear substrate 14. Similarly, a plurality of linear electrodes (row electrodes) 17 (hereinafter referred to as "row electrodes") are provided on the surface of the rear substrate 14 facing the display substrate 12. The display substrate 12 and the rear substrate 14 are disposed facing each other such that the column electrodes 16 and the row electrodes 17 provided therein are orthogonal with each other (see FIG. 1).

For simplifying explanation, this embodiment is provided in a 4×4 simple matrix configuration including the four column electrodes 16 of the display substrate 12 (a, b, c, d) and the row electrodes 17 of the rear substrate 14 (i, ii, iii, iv). In actual practice, electrodes of numbers corresponding to the vertical and lateral pixel counts necessary for image display will be formed on the substrates. Moreover, although in this embodiment the linear electrodes 16 of the display substrate 12 are column electrodes and the linear electrodes 17 of the rear substrate 14 are row electrodes, an opposite configuration with the row electrodes provided on the display substrate 12 and the column electrodes provided on the rear substrate 14 can also be adopted.

Between the display substrate 12 and the rear substrate 14, particle groups having different charge characteristics, positively charged black particles 20 and negatively charged white particles 22, are sealed.

The image display medium 10 is connected with the driving device 82. Specifically, the column electrodes 16 of the display substrate 12 and the row electrodes 17 of the rear substrate 14 are connected with a column electrode driving circuit 30 and a row electrode driving circuit 32, and the column electrode driving circuit 30 and the row electrode driving circuit 32 are each connected with a sequencer 34 and an external power source 36. The sequencer 34 is connected with an image inputting device 38 so as to output image information signals to the column electrode driving circuit 30 and the row electrode driving circuit 32 according to optional image information inputted from the image inputting device 38.

According to the simple matrix drive, an image writing signal (scanning signal) for each row is sent from the sequencer 34 to the row electrode driving circuit 32 so that an image writing voltage is applied from the row electrode driving circuit 32 successively to the row electrodes 17 of the rear substrate 14. At the same time, synchronously with the image writing voltage being applied successively to the row electrodes 17 of the rear substrate 14, an image information signal corresponding to the row to which the image writing voltage is being applied is sent from the sequencer 34 to the column electrode driving circuit 30, and image writing voltages corresponding to the row being written are simultaneously applied from the column electrode driving circuit 30 to the column electrodes 16 of the display substrate 12. This operation is executed successively from the first row to the final row so as to display a desired image.

Hereinafter, operation of the image display medium according to the present invention will be explained. Here, an example of executing a black image display on a white display surface by the simple matrix driving method will be explained. In the description below, an image writing voltage to be applied to the column electrodes 16 of the display substrate 12 according to the image information signal is described as $V_{SB}$, and an image writing voltage to be applied successively to the row electrodes 17 of the rear substrate 14 is described as $V_{LB}$. Moreover, all the electrodes without image writing are 0 V or grounded.

When changing from the white display to the black display, at the pixels shown by slant lines in FIG. 1 (that is, at pixels at portions whereat the column electrode and the row electrode intersect as follows: row i, column a; row i, column c; row ii, column b; row ii, column d; row iii, column a; and row iii, column c), first, in order to execute the image display for row i, the image writing voltage $V_{LB}$ is applied to the i-th row electrode of the rear substrate 14 and, synchronously therewith, the image writing voltage $V_{SB}$ is applied to column a and column c of the display substrate 12. Next, in order to execute the image display for row ii, the voltage $V_{LB}$ is applied to the ii-th row of the rear substrate 14 and, synchronously therewith, the image writing voltage $V_{SB}$ is applied to column b and column d of the display substrate 12. Next, in order to execute the image display for row iii, the image writing voltage $V_{LB}$ is applied to the iii-th row of the rear substrate 14 and, synchronously therewith, the image writing voltage $V_{SB}$ is applied to column a and column c of the display substrate 12.

Therefore, at the pixels to be changed from the white display to the black display, a display driving electric field $|V_{SB}-V_{LB}|/d_1$ is generated ($d_1$ is the distance between the substrates). Moreover, since a driving electric field $|V_{SB}|/d_1$ or $|V_{LB}|/d_1$ is also generated at other pixels, at which the black display is not required, it is necessary that the display not be changed even when the field $|V_{SB}|/d_1$ or $|V_{LB}|/d_1$ is generated; that is, the particles thereat must not be moved between the substrates.

Figure 4:
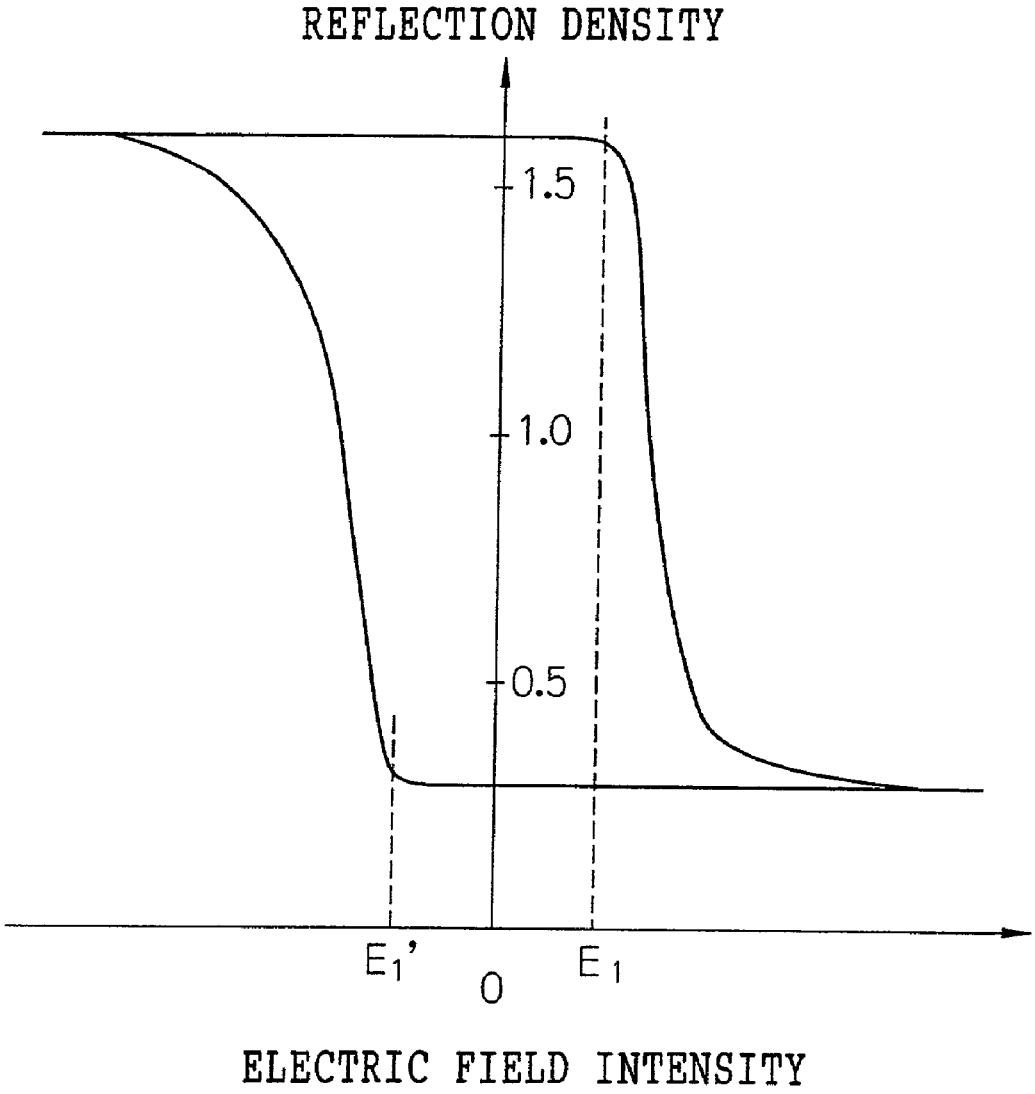
FIG. 4 is a graph showing the relationship between the electric field intensity between the electrodes facing each other and the image display density.

FIG. 4 shows the relationship between the electric field intensity applied between the display substrate 12 and the rear substrate 14 and the image display density (reflection density) in the image display medium 10 used in this embodiment. This is an example of an image display medium to be changed from black display to white display by a positive electric field and from white display to black display by a negative electric field. According to FIG. 4, the display density is changed according to the electric field intensity such that a higher display contrast can be obtained with higher electric field intensity. Moreover, it is observed that there can be an electric field up to the positive electric field intensity $E_1$ or to the negative electric field intensity $E_1'$ without movement of the particles, so as not to change the display density. Therefore, in the image display medium 10, in order to obtain a higher display contrast by the simple matrix drive, it is necessary to enlarge $|V_{SB}-V_{LB}|/d_1$ as much as possible and to set $V_{SB}$ and $V_{LB}$ at values just below values for starting the particle movement between the substrates, so as not to change the display even when a field $|V_{SB}|/d_1$ or $|V_{LB}|/d_1$ is generated.

Similarly, when executing white image display on a black display surface by the simple matrix drive, when the image writing voltage to be applied to the column electrodes 16 of the display substrate 12 according to the image information signal is $V_{SW}$, and the image writing voltage to be applied to the row electrodes 17 of the rear substrate 14 is $V_{LW}$, a display driving electric field of $|V_{SW}-V_{LW}|/d_1$ is generated at the pixel to be changed from the white display to the black display. However, the driving electric field of $|V_{SW}|/d_1$ or $|V_{LW}$651 $/d_1$ is also generated at pixels that are to remain black and not execute the white display. Therefore, as mentioned above, in order to obtain a higher display contrast, it is necessary that $|V_{SW}-V_{LW}|/d_1$ is enlarged as much as possible, and to set $V_{SW}$ and $V_{LW}$ at values just below values for starting the particle movement.

Although the row electrodes 17 and the column electrodes 16 not for writing an image are at 0 V or grounded in this embodiment, an optional voltage may be applied to the non-image writing row electrodes 17 and column electrodes 16, as long as executing the display in the image part does not result in unnecessary movement of the particles between the substrates at pixels corresponding to the non-image part as mentioned above.

Next, predicted behavior of the particles at the time of image display will be explained. First, the behavior of the particles in the A—A cross-sectional view (see FIG. 2A) of the image display medium 10 shown in FIG. 1 is shown in FIGS. 5A to 5F in a time series order. This example is of executing a black image display (dot display) from a white display state shown in FIG. 5A.

Figure 5A:
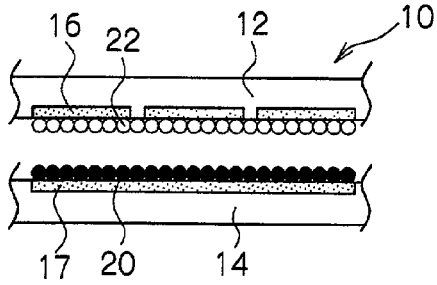
FIGS. 5A to 5F are explanatory diagrams showing an example of movement states of particles in the image display device according to the first embodiment of the present invention.
Figure 5B:
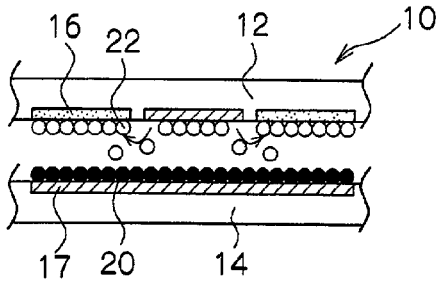

First, as shown in FIG. 5B, the image writing voltage $V_{LB}$ is applied to the row electrodes 17 of the rear substrate 14 and, at the same time, the image writing voltage $V_{SB}$ is applied to one of the column electrodes 16 (slant line part) of the display substrate 12 for writing the image. Thus, as shown by the arrows in FIG. 5B, an edge electric field is generated between the column electrode (slant line part) of the display substrate 12, to which the image writing voltage is applied, and the column electrodes adjacent thereto. The edge electric field at this time is $|V_{SB}|/d_2$ ($d_2$ is the distance from the adjacent column electrode 16). Since the distance between the adjacent electrodes $d_2$ is extremely small compared to the distance between the substrates $d_1$, the edge electric field is strong. Therefore, the white particles 22 in the vicinity between the adjacent electrodes start to move while being spread by the edge electric field.

Figure 5C:
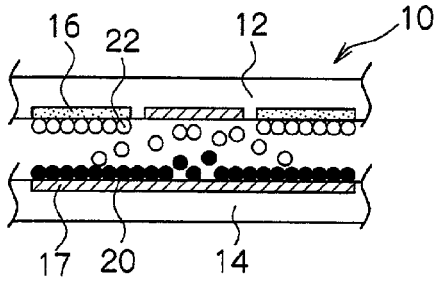
Figure 5D:
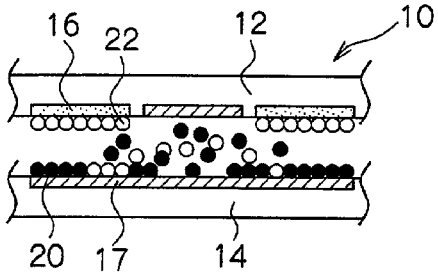

Thereafter, as shown in FIG. 5C, the particles are moved according to the electric field. As shown in FIG. 5D, the white particles 22 spreadingly moved reach a spread state beyond the area corresponding to the pixels of the rear substrate 14 and clash with the black particles 20 adhered thereon. At this time, the electric field ($|V_{LB}|/d_1$) is also formed in the non-image part area. Although $V_{LB}$ is set so as not to move the particles between the substrates by the electric field intensity as mentioned above, some of the black particles 20 in the non-image part area may be moved by impact forces of the collisions between the particles.

Figure 5E:
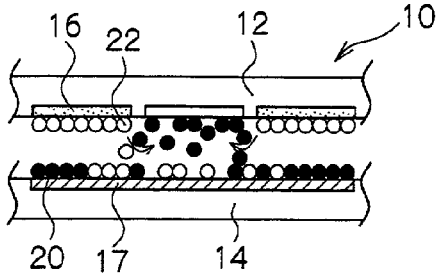
Figure 5F:
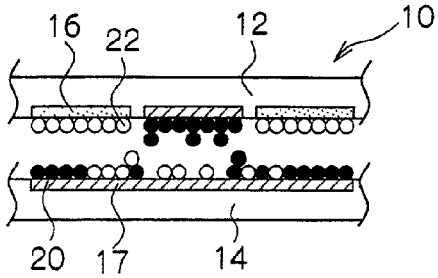

However, as shown in FIG. 5E, the black particles 20 moved to the display substrate 12 side are moved toward the image-writing column electrode 16 by the above-mentioned edge electric field (arrows in the figure). As shown in FIG. 5F, the black display without spreading can be executed as a result. Moreover, by executing the same successively for each row, a black vertical line image can be displayed along the column electrodes 16 on the white display surface so that a sharp vertical line image can be obtained with a high image density without line thickening.

Figure 6A:
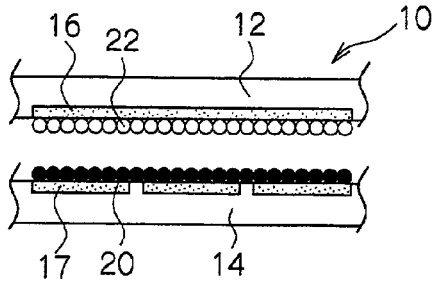
FIGS. 6A to 6F are explanatory diagrams showing an example of movement states of the particles in the image display device according to the first embodiment of the present invention.
Figure 6B:
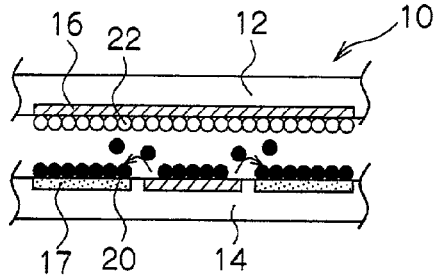

Next, in FIGS. 6A to 6F, the behavior of the particles in the B—B cross-sectional view (see FIG. 2B) of the image display medium 10 shown in FIG. 1 is shown in the time series order. This is an example of executing the black pixel display (dot display) from the white display state shown in FIG. 6A. First, as shown in FIG. 6B, the image writing voltage $V_{LB}$ is applied to one of the row electrodes 17 (slant line part) of the rear substrate 14 for writing the image and, at the same time, the image writing voltage $V_{SB}$ is applied to the column electrodes 16 of the display substrate 12. Thus, as shown by the arrows in FIG. 6B, an edge electric field is generated between the image-writing row electrode (slant line part) of the rear substrate 14, and the row electrodes adjacent thereto. The edge electric field at this time is $|V_{LB}|/d_3$ ($d_3$ is the distance between the adjacent column electrodes). Since the distance between the adjacent electrodes $d_3$ is extremely small compared to the distance between the substrates $d_1$, the edge electric field is strong. Therefore, the black particles 20 existing in the vicinity between the adjacent electrodes start movement while spreading by the edge electric field.

Figure 6C:
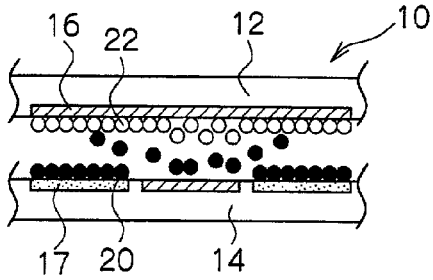
Figure 6D:
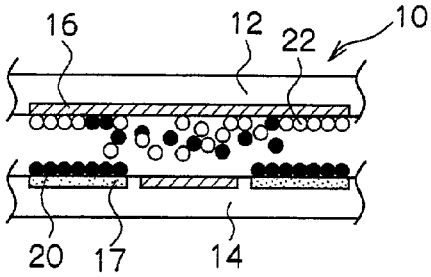

Thereafter, as shown in FIG. 6C, the particles are moved by the electric field. As shown in FIG. 6D, the black particles 20 moved while spreading reach a spread state beyond the area corresponding to the pixels of the display substrate 12 and clash with the white particles 22 adhered thereon. At this time, the electric field ($|V_{SB}|/d_1$) is formed also in the non-image part area. Although $V_{SB}$ is set so as not to move the particles between the substrates by the electric field intensity as mentioned above, some of the white particles 22 in the non-image part area may be moved by the impact forces of the collisions between the particles.

Figure 6E:
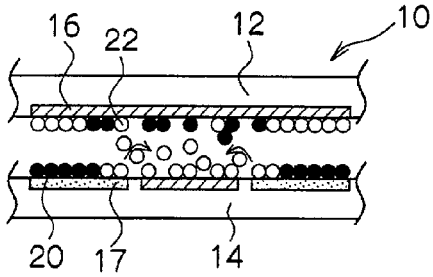
Figure 6F:
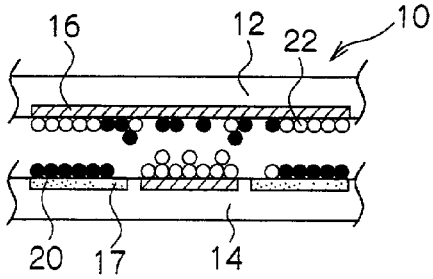

Therefore, after the state of FIG. 6E, consequently, the displayed black display image is spread as shown in FIG. 6F, and furthermore, the surface density of the black particles 20 for forming the image is made smaller so that the density is lowered as well. Therefore, when displaying a lateral line image along the row electrodes 17 formed on the rear substrate 14, a lateral line image with line thickening and density deterioration is provided.

Accordingly, before application of the display drive voltage for executing the image display, a voltage is applied so as to generate a potential difference allowing the movement of the particles between the adjacent electrodes in the rear substrate 14.

The behavior of the particles at this time is shown in FIGS. 7A to 7F in the time series order. FIGS. 7A to 7F show the behavior of the particles in the B—B cross-section of the image display medium 10 shown in FIG. 1, similarly to FIGS. 6A to 6F, as an example of executing the black image display (dot display) from the white display state shown in FIG. 7A.

Figure 7A:
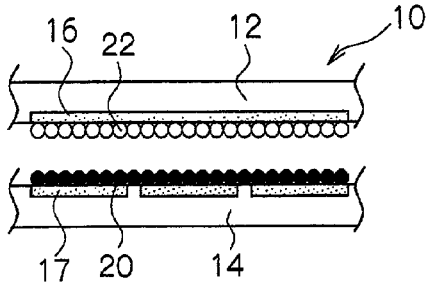
FIGS. 7A to 7F are explanatory diagrams showing an example of movement states of the particles in the image display device according to the first embodiment of the present invention.
Figure 7B:
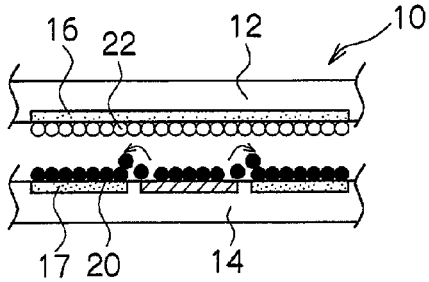
Figure 7C:
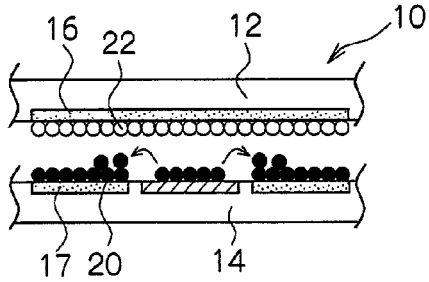

In this embodiment, first, as shown in FIG. 7B, a voltage $V_{LP1}$ that moves the particles between the adjacent row electrodes without moving the particles between the substrates facing each other is applied to the image-writing row electrode 17 (slant line part) of the rear substrate 14. Here, the voltage $V_{LP1}$ is a voltage for moving the black particles 20 in the vicinities between the adjacent electrodes from the image-writing row electrode side (slant line part) toward the row electrodes adjacent thereto. Then, by the edge electric field $|V_{LP1}|/d_3$ formed between the adjacent electrodes as shown by the arrows in the figure, the black particles 20 in the vicinities between the adjacent electrodes are moved from the image-writing row electrode side (slant line part) to the adjacent row electrode side. As shown in FIG. 7C, a state without the black particles 20 between the adjacent electrodes is achieved.

Figure 7D:
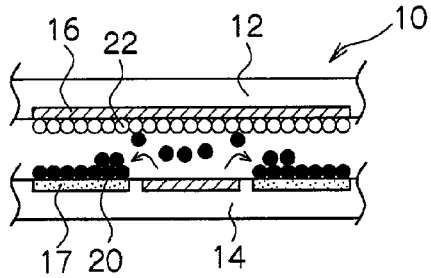

Next, an image writing voltage $V_{LB}$ is applied to the image-writing row electrode 17 (slant line part) on the rear substrate 14 and, at the same time, the image writing voltage $V_{SB}$ is applied to on of the column electrodes 16 on the display substrate 12. Consequently, as shown in FIG. 7D, since the particles in the vicinity of the adjacent electrodes have been preliminarily removed and moved, the number of the black particles 20 spreadingly moved by the edge electric field $|V_{LB}|/d_3$ formed at this time can be reduced.

Figure 7E:
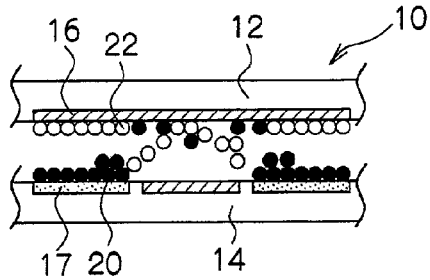
Figure 7F:
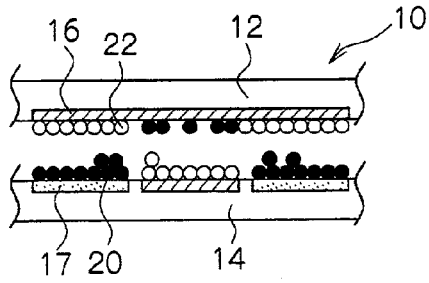

Thereafter, as shown in FIG. 7E, the particles are moved according to the electric field, and consequently, as shown in FIG. 7F, a display image with little spreading of the particles can be obtained. Therefore, even when displaying a lateral line image along the row electrodes 17 formed on the rear substrate 14, line thickening can be reduced.

Here, by applying the voltage $V_{LP1}$ for preliminarily moving and eliminating the particles in the vicinities between the adjacent electrodes to the image-writing row electrodes 17 (slant line part) of the rear substrate 14, an electric field $|V_{LP1}|/d_1$ is formed with respect to the column electrodes 16 of the display substrate 12 at the same time. Since image deterioration such as image disturbance and griminess will be generated if the particles are moved between the substrates by the electric field, $V_{LP1}$ is set at a voltage value that will not move the particles between the substrates facing each other. Since the distance between the adjacent electrodes is small compared to the distance between the substrates, as mentioned above, the particles can be moved sufficiently between the adjacent electrodes by a voltage value that will not cause movement between the substrates.

According to this embodiment, by applying a voltage to the image-displaying electrodes for generating a potential difference (electric field) between the adjacent electrodes so as to preliminarily move the particles at the edge part of the image display-executing electrodes onto the other electrodes, spreading movement of the particles at the time of applying the voltage for the image display can be prevented. Therefore, adhesion of the particles at a part of the display substrate outside the image display can be prevented, and blurring and the like of the image to be displayed can be prevented, thus improving the quality of the displayed image.

Although a voltage is applied to the image-writing row electrodes for moving the particles with respect to the row electrodes adjacent thereto in this embodiment, a voltage may instead be applied to the row electrodes that do not write the image, or a voltage may be applied to both of these, as long as the particles in the vicinities between the adjacent electrodes can be preliminarily removed and moved, and display deterioration such as image disturbance and griminess is not generated. An optional voltage may also be applied to the column electrodes 16 formed on the display substrate 12.

Figure 8:
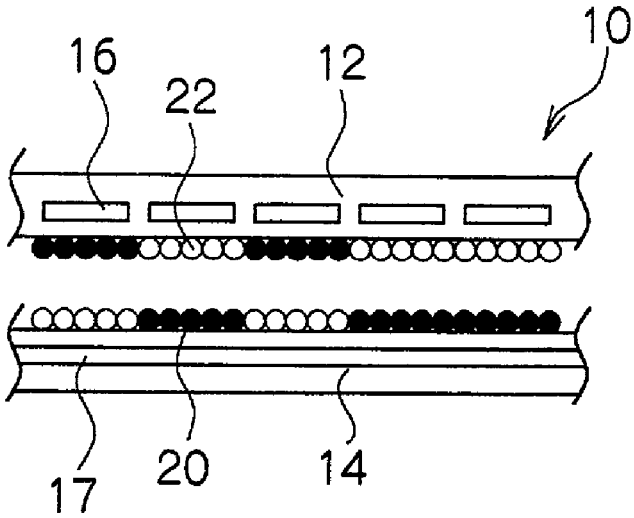
FIG. 8 is an explanatory diagram showing another example of an image display medium according to the first embodiment of the present invention.
Figure 9:
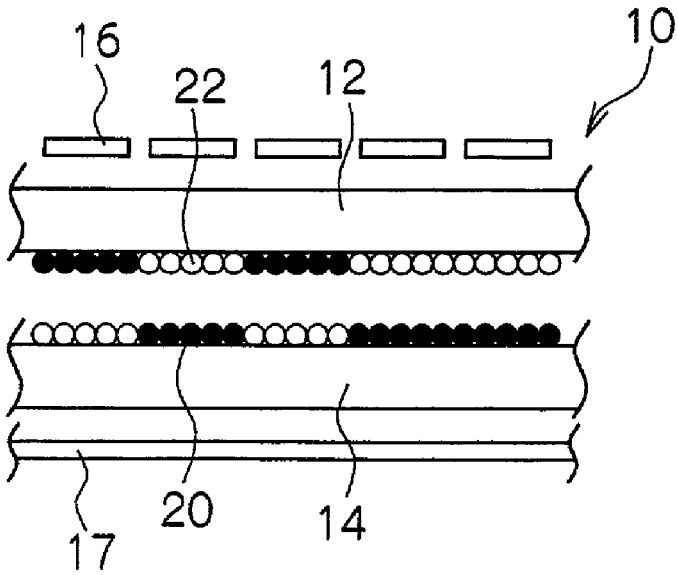
FIG. 9 is an explanatory diagram showing another example of an image display medium according to the first embodiment of the present invention.

The linear electrodes 16 formed on the display substrate 12 and the linear electrodes 17 formed on the rear substrate 14 need not be formed on the substrate surfaces. They may be embedded in the display substrate 12 and the rear substrate 14 as shown in FIG. 8, or they may be disposed outside the image display medium 10 as shown in FIG. 9.

(Second Embodiment)

Hereinafter, a second embodiment of the present invention will be explained.

Since the image display device of this embodiment has the same configuration as that of the above-mentioned image display device, explanation thereof is not provided. Only the driving embodiment of the driving device, that is, the behavior of the particles in the image display medium 10, will be explained.

FIGS. 10A to 10F show the behavior of the particles in this embodiment in the time series order. Similarly to FIGS. 6A to 6F and FIGS. 7A to 7F, FIGS. 10A to 10F show the behavior of the particles in the B—B cross-sectional view (see FIG. 2B) of the image display medium shown in FIG. 1 as an example of executing the black pixel display (dot display) from the white display state shown in FIG. 10A.

Figure 10A:
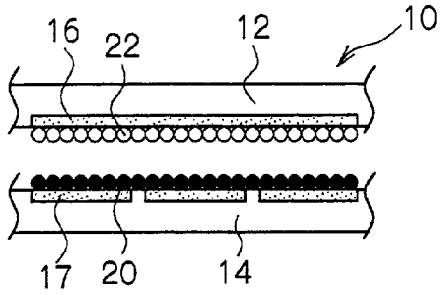
FIGS. 10A to 10F are explanatory diagrams showing an example of movement states of particles in an image display device according to a second embodiment of the present invention.
Figure 10B:
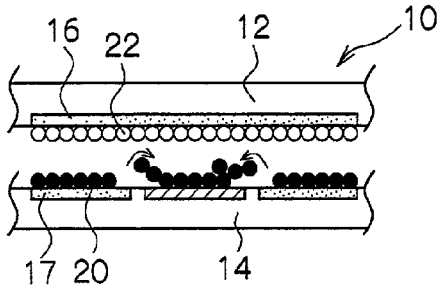
Figure 10C:
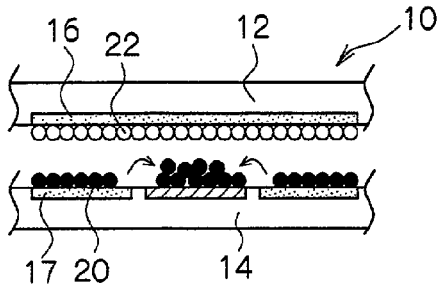

In this embodiment, first, as shown in FIG. 10B, a voltage $V_{LP2}$ that moves the particles between the adjacent row electrodes without moving the particles between the substrates facing each other is applied to the row electrodes 17 of the rear substrate 14 that write the image (slant line part). Here, in contrast to the first embodiment, the voltage $V_{LP2}$ is a voltage for moving the black particles 20 in the vicinities between the adjacent electrodes onto the image-writing row electrode (slant line part) side from the adjacent row electrode side. Here, by the edge electric field $|V_{LP2}|/d_3$ formed between the adjacent electrodes as shown by the arrows in the figure, the black particles 20 in the vicinities between the adjacent electrodes are moved from the adjacent row electrode side onto the image-writing row electrodes (slant line part). As shown in FIG. 10C, a state without the black particles 20 between the adjacent electrodes is achieved.

Figure 10D:
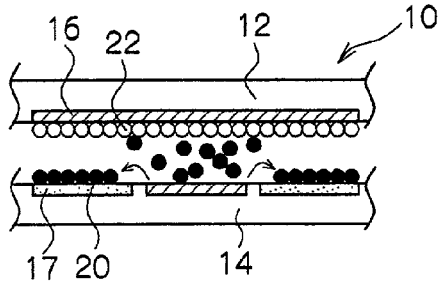

Next, an image writing voltage $V_{LB}$ is applied to the row electrodes 17 (slant line part) of the rear substrate 14 for writing the image and, at the same time, an image writing voltage $V_{SB}$ is applied to the column electrodes 16 of the display substrate 12. Then, as shown in FIG. 10D, since the particles in the vicinity of the adjacent electrodes have been preliminarily removed and moved, the number of the black particles 20 spreadingly moved by the edge electric field $|V_{LB}|/d_3$ formed at this time can be reduced. Moreover, since the particles in the vicinities between the adjacent electrodes are preliminarily moved onto the image-writing row electrodes (slant line part), the black particles 20 moved by the display drive can be increased.

Figure 10E:
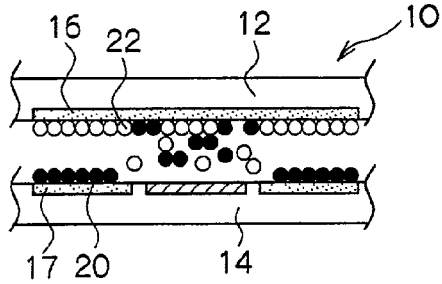
Figure 10F:
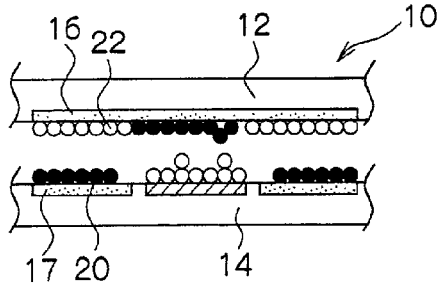

Thereafter, as shown in FIG. 10E, the particles are moved according to the electric field, and consequently, as shown in FIG. 10F, a display image with little spreading of the particles and a high particle density can be obtained. Therefore, even when displaying a lateral line image along the row electrodes 17 formed on the rear substrate 14, line thickening can be reduced.

According to this embodiment, by applying a voltage to the electrodes that display the image for generating a potential difference (electric field) between the adjacent electrodes, so as to preliminarily move the particles at the edge parts of the electrodes that do not execute the image display onto the image-displaying electrodes, the number of spreadingly moved particles can be reduced and a sufficient amount of the particles can be adhered onto the display substrate at the time of applying the voltage for the image display. Thus, blurring of the displayed image, density deterioration, and the like can be prevented. Thus, deterioration of the contrast of the displayed image can be prevented and the quality of the displayed image can be improved.

(Third Embodiment)

Hereinafter, a third embodiment of the present invention will be explained. In this embodiment, the same numerals are provided for the same parts as those in the above-mentioned first embodiment and second embodiment and further explanation is not given therefor.

Figure 11:
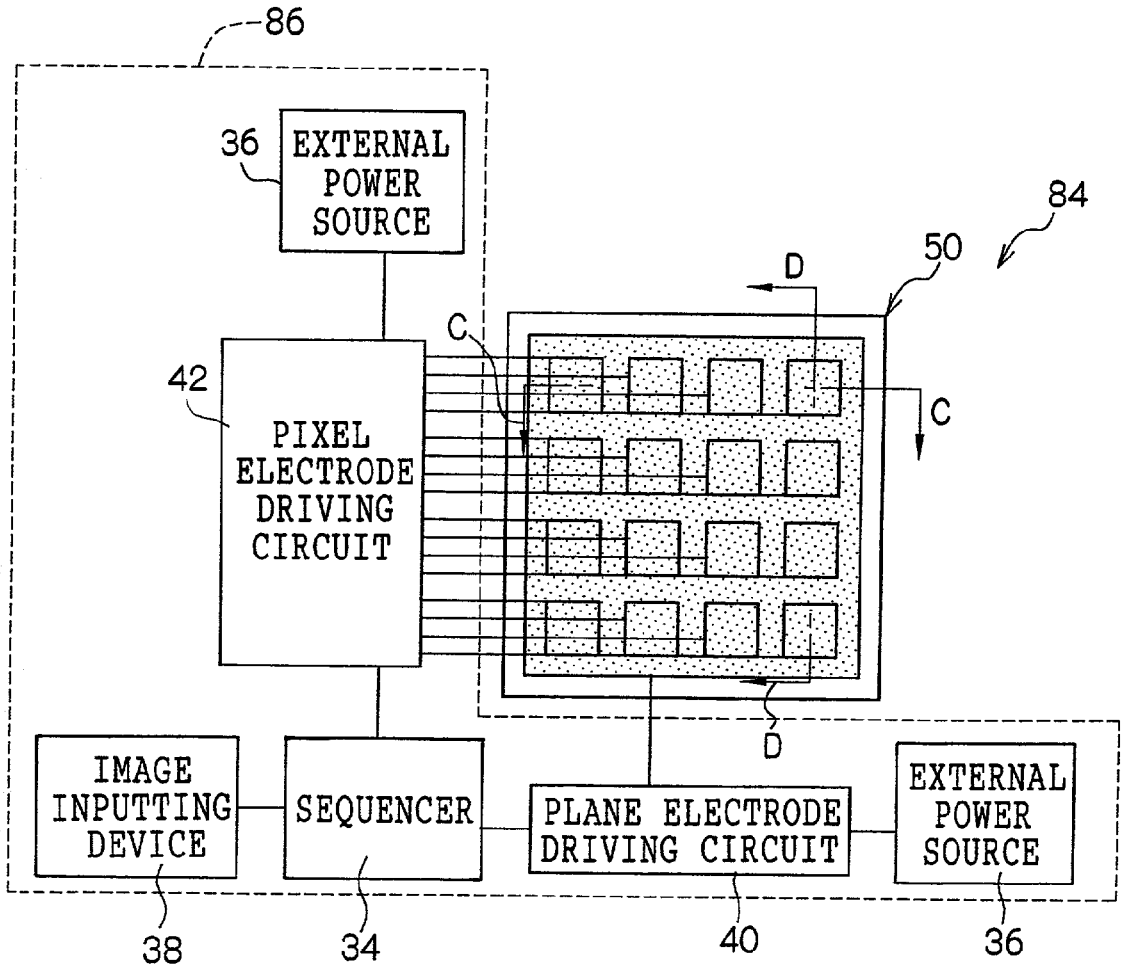
FIG. 11 is an explanatory diagram of an image display device of an active matrix driving method according to a third embodiment of the present invention.
Figure 12A:
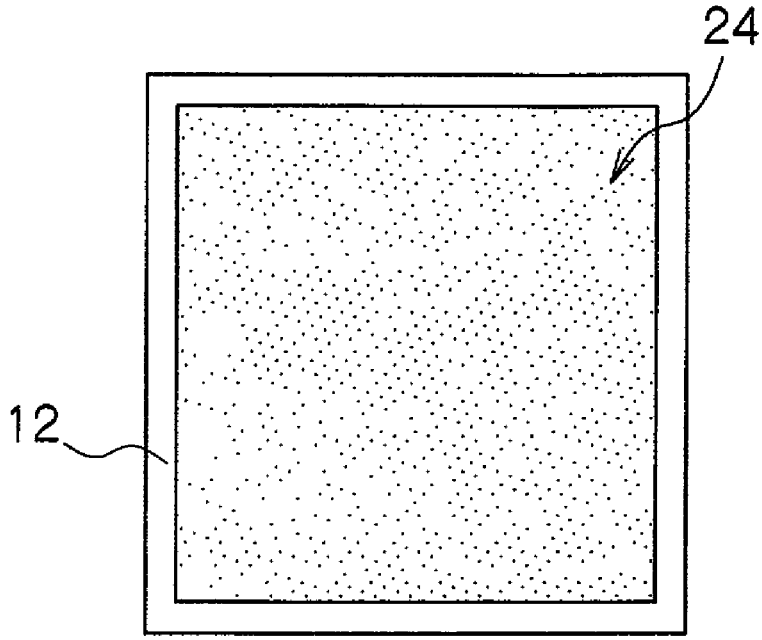
FIG. 12A is a front view of a display substrate of the image display medium according to the third embodiment of the present invention.
Figure 12B:
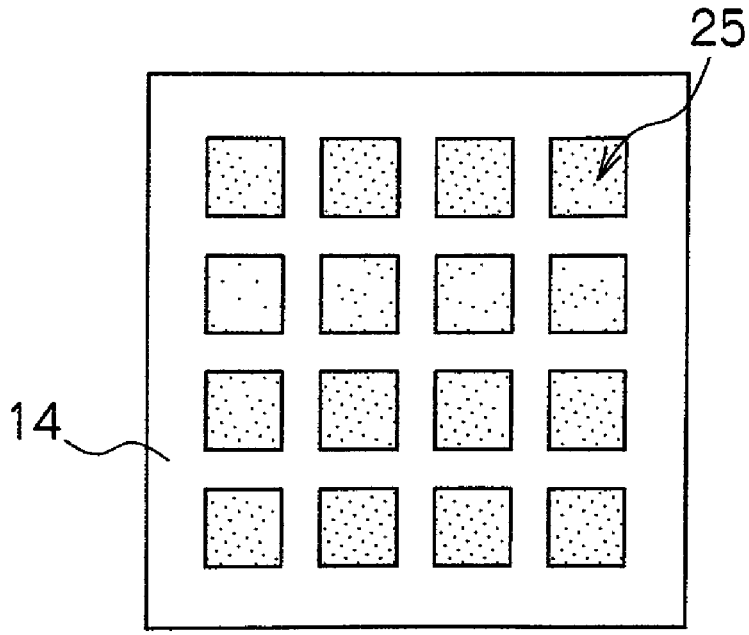
FIG. 12B is a front view of a rear substrate of the image display medium according to the third embodiment of the present invention.

An image display device 84 according to this embodiment is shown in FIGS. 11, 12A and 12B. The image display device 84 comprises an image display medium 50 and a driving device 86 for driving the same. The image display medium 50 is to be driven by the so-called active matrix driving method. A uniform electrode 24 (hereinafter referred to as the plane electrode 24) is provided on the surface of the display substrate 12 facing the rear substrate 14. Moreover, a plurality of electrodes 25 (hereinafter referred to as the pixel electrodes 25) are provided on the surface of the rear substrate 14 facing the display substrate 12, corresponding to each pixel.

Moreover, as shown in FIG. 11, in this embodiment, the plane electrode 24 of the display substrate 12 and the pixel electrodes 25 of the rear substrate 14 are connected with a plane electrode driving circuit 40 and a pixel electrode driving circuit 42, and the plane electrode driving circuit 40 and the pixel electrode driving circuit 42 are each connected with a sequencer 34 and an external power source 36. The sequencer 34 is connected with an image inputting device 38 so as to output an image information signal to the plane electrode driving circuit 40 and the pixel electrode driving circuit 42 according to optional image information inputted form the image inputting device 38. In this embodiment, the image writing signal for each pixel is sent from the sequencer 34 to the pixel electrode driving circuit 42, and the image writing voltage is applied simultaneously from the pixel electrode driving circuit 42 to the pixel electrodes 25 of the rear substrate 14. Moreover, the plane electrode 24 of the display substrate 12 is 0 V or grounded.

According to the active matrix drive, since an optional voltage can be applied to an optional pixel, for example, a driving voltage $V_{AW}$ sufficient for executing the white display can be applied to pixel electrodes for writing a white image and a driving voltage $V_{AB}$ sufficient for executing the black display can be applied to pixel electrodes for writing a black image. However, when the driving voltages $V_{AW}$ and $V_{AB}$ are set so as to achieve a sufficient display density, an extremely strong edge electric field $|V_{AW}-V_{AB}|/d_4$ ($d_4$ is the distance between the pixel electrodes) is formed between adjacent electrodes of the rear substrate 14 corresponding to an image edge part. When an image display medium of high resolution, a problem is involved in that the display contrast will be extremely deteriorated since the particles are moved only between the adjacent electrodes without movement to the display substrate 12.

Accordingly, in this embodiment, first, the entire surface is provided as a white display or a black display, and then an image is written. Thus, since the edge electric field formed between the adjacent electrodes of the rear substrate 14 corresponding to the image edge part becomes $|V_{AW}|/d_4$ or $|V_{AB}|/d_4$, the particles moved to the display substrate 12 side can be increased, so that extreme density deterioration at a high resolution can be prevented.

Hereinafter, predicted behavior of the particles at the time of image display in the image display medium 50 will be explained. Here, the C—C cross-sectional view and the D—D cross-sectional view of the image display device shown in FIG. 11 correspond to FIG. 2B explained in the above-mentioned first embodiment. The movement state of the particles in each cross-section is the same as that explained in the first embodiment with reference to FIGS. 6A to 6F, and is equivalent to the situation explained in FIGS. 6A to 6F with the column electrodes 16 of the display substrate 12 substituted by the plane electrode 24, and the row electrodes 17 of the rear substrate 14 substituted by the pixel electrodes 25.

Now, the particle movement in this embodiment will be explained briefly with reference to FIGS. 6A to 6F. First, a voltage $V_{AW}$ for executing the white display is applied to all the pixel electrodes 25 of the rear substrate 14 so as to have the entire display surface white (see FIG. 6A). Then, the image writing voltage $V_{AB}$ is applied to the pixel electrodes 25 of the rear substrate 14 that are to write the black image (see FIG. 6B, slant line part). Then, as shown by the arrows in FIG. 6B, an edge electric field is generated between the pixel electrodes of the rear substrate 14 to which the image writing voltage is applied (slant line part) and the pixel electrodes adjacent thereto, so that the black particles 20 in the vicinities between the adjacent electrodes start moving while being spread by the edge electric field.

Thereafter, the particles are moved according to the generated electric field (see FIG. 6C) so that the black particles 20 reach a state spreading beyond the area corresponding to the pixel part of the display substrate 12 (see FIG. 6D). Since the surface density of the black particles 20 for forming the image is made smaller as a result, the density is lowered (see FIG. 6F).

Hence, according to the image display medium 50, before application of the display drive voltage for executing the image display, a voltage for generating a potential difference that moves the particles is applied between the display-executing pixel electrodes and the pixel electrodes adjacent thereto.

Figure 2A:
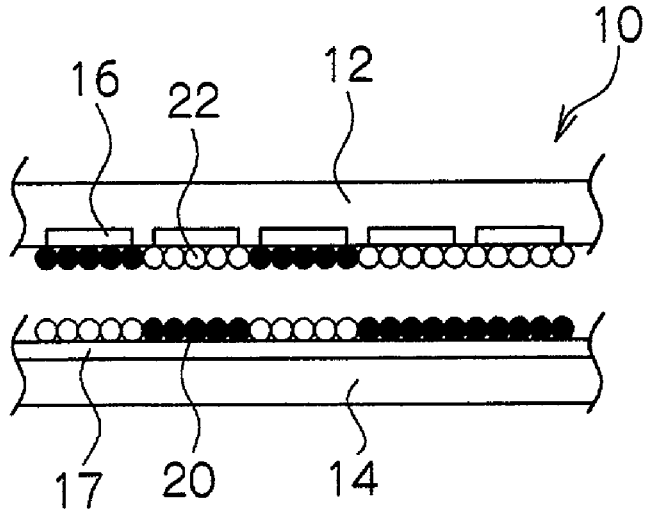
FIG. 2A is a cross-sectional view taken on the line A—A of FIG. 1.
Figure 2B:
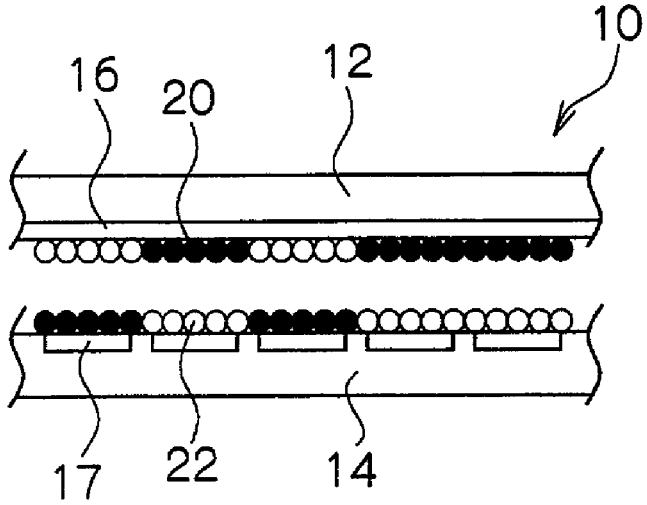
FIG. 2B is a cross-sectional view taken on the line B—B of FIG. 1.

Here, as mentioned above, the C—C cross-sectional view and the D—D cross-sectional view of the image display device of FIG. 11 correspond to FIG. 2B explained in the first embodiment. Therefore, the particle movement state in each cross-section is substantially the same as that explained in the first embodiment with reference to FIGS. 7A to 7F, that is, the situation in FIGS. 7A to 7F with the column electrodes 16 of the display substrate 12 substituted by the plane electrode 24 and the row electrodes 17 of the rear substrate 14 substituted by the pixel electrodes 25.

Hereinafter, the particle movement in this embodiment will be explained briefly with reference to FIGS. 7A to 7F. First, a voltage $V_{AW}$ for executing the white display is applied to all the pixel electrodes 25 of the rear substrate 14 so as to have the entire surface of the display substrate in the white display (see FIG. 7A). Then, a voltage $V_{AP1}$ that moves the particles between the adjacent pixel electrodes without movement between the substrates facing each other is applied to the image-writing pixel electrodes 25 (slant line part) of the rear substrate 14 (see FIG. 7B). Here, the voltage $V_{AP1}$ is a voltage for moving the black particles 20 in the vicinities between the adjacent electrodes from the image-writing pixel electrode (slant line part) side toward the adjacent pixel electrodes. Thus, by the edge electric field $|V_{AP1}|/d_4$ formed between the adjacent electrodes as shown by the arrows in FIGS. 7B to 7D, the black particles 20 in the vicinities between the adjacent electrodes are moved from the image-writing pixel electrode (slant line part) side to the adjacent electrodes so as to form the state without the black particles 20 between the adjacent electrodes (see FIG. 7C).

Next, by applying the image writing voltage $V_{AB}$ to the image-writing pixel electrodes (slant line part) of the rear substrate 14, since the particles in the vicinity between the adjacent electrodes have been preliminarily removed and moved, the number of the black particles 20 spreadingly moved by the edge electric field $|V_{AB}|/d_4$ formed at this time is reduced (see FIG. 7D).

Thereafter, the black particles 20 and the white particles 22 are moved by the electric field (see FIG. 7E) and, consequently, a display image with little spreading of the particles can be obtained (see FIG. 7F). Therefore, also in the image display medium 50 of the active matrix driving method, spreading of image edge parts can be reduced.

Although the plane electrode 24 of the display substrate 12 is 0 V or grounded in this embodiment, an optional voltage can be applied thereto by the external power source 36, or a signal can be inputted by the sequencer 34 so as to apply a desired voltage synchronously with the voltage applied to the pixel electrodes 25 of the rear substrate 14. Moreover, although the image writing voltage is applied simultaneously to the pixel electrodes 25 of the rear substrate 14 in this embodiment, the voltage may be applied successively by row or by column by the sequencer 34, or the voltage may be applied in an optional order.

Furthermore, although explanation has been given for the active matrix driving method in this embodiment, the driving method of the present invention can be adopted with a segment driving method with a fine optional electrode pattern on a rear substrate.

(Fourth Embodiment)

Hereinafter, a fourth embodiment of the present invention will be explained.

In this embodiment, image display is executed by a voltage applying method different from that of the third embodiment in the above-mentioned image display medium 50 using the active matrix drive. Therefore, since the image display device according to this embodiment has the same configuration as that of the above-mentioned image display device 84, explanation thereof is not given here.

Moreover, as above, the C—C cross-sectional view and the D—D cross-sectional view of the image display device of FIG. 11 correspond to FIG. 2B explained in the first embodiment. Therefore, the particle movement state in each cross-section is substantially the same as that explained in the first embodiment with reference to FIGS. 10A to 10F, that is, the situation in FIGS. 10A to 10F with the column electrodes 16 of the display substrate 12 substituted by the plane electrode 24 and the row electrodes 17 of the rear substrate 14 substituted by the pixel electrodes 25.

Hereinafter, the particle movement in this embodiment will be explained briefly with reference to FIGS. 10A to 10F. First, a voltage $V_{AW}$ for executing the white display is applied to all the pixel electrodes 25 of the rear substrate 14 so as to have the entire surface of the display substrate 12 in the white display (see FIG. 10A). Then, a voltage $V_{AP2}$ that moves the particles between the adjacent pixel electrodes without movement between the substrates facing each other is applied to the image-writing pixel electrodes 25 (slant line part) of the rear substrate 14 (see FIG. 10B). Here, in contrast to the third embodiment, the voltage $V_{AP2}$ is a voltage for moving the black particles 20 in the vicinities between the adjacent electrodes onto the image-writing pixel electrodes (slant line part) from the side of the pixel electrodes adjacent thereto. Then, due to the edge electric field $|V_{AP2}|/d_4$ formed between the adjacent electrodes as shown by the arrows in the figure, the black particles 20 in the vicinities between the adjacent electrodes are moved from the adjacent pixel side onto the image-writing pixel electrodes (slant line part) so as to achieve the state without the black particles 20 between the adjacent electrodes (see FIG. 10C).

Next, by applying the image writing voltage $V_{AB}$ to the image-writing pixel electrodes (slant line part) of the rear substrate 14, since the particles in the vicinity between the adjacent electrodes have been preliminarily removed and moved, the number of the black particles 20 spreadingly moved by the edge electric field $|V_{AB}|/d_4$ formed at this time is reduced (see FIG. 10D). Moreover, since the particles in the vicinities between the adjacent electrodes have been preliminarily moved onto the image-writing pixel electrodes (slant line part), the black particles 20 moved by the display drive can be increased.

Thereafter, the particles are moved according to the electric field (see FIG. 1E) and, consequently, a display image with little spreading of the particles and a high particle density can be obtained (see FIG. 10F). Therefore, also in the image display medium 50 of the active matrix driving method, spreading of the image edge part can be reduced.

EXAMPLE 1

Figure 13A:
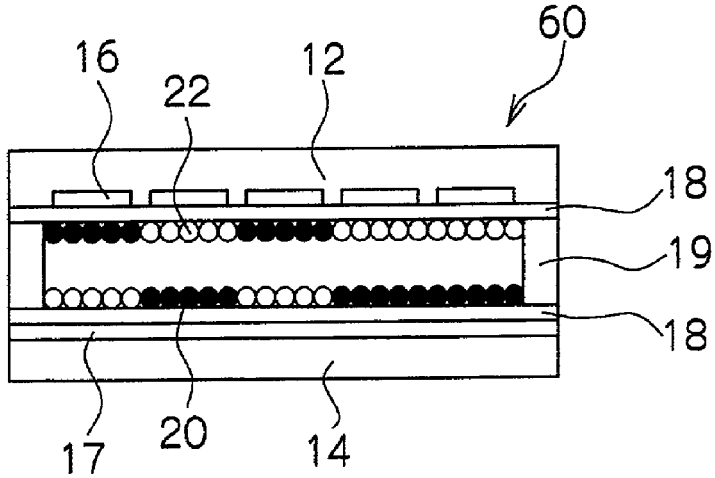
FIGS. 13A and 13B are cross-sectional views showing schematic configuration of an image display medium according to Example 1 of the present invention.
Figure 13B:
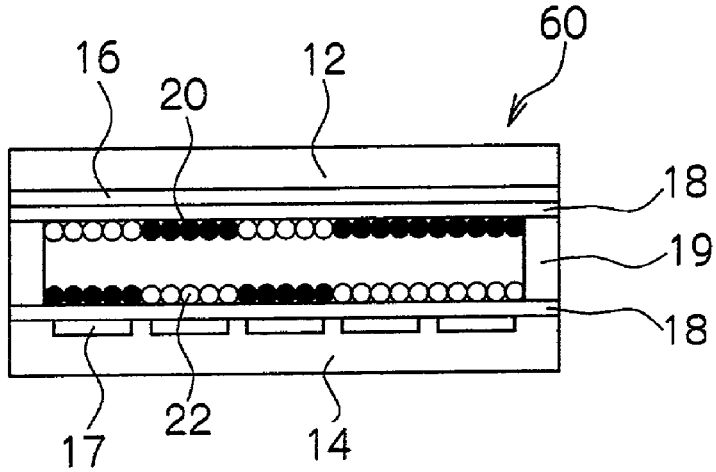

In this Example, an example of the image display medium 10 according to the present invention will be explained. The image display medium 10 was driven for display by the so-called simple matrix driving method and included an image display medium 60 and a driving device (not shown). FIGS. 13A and 13B are cross-sectional views of the image display medium 60 of the simple matrix driving method used in this Example.

As the display substrate 12 for the image display medium 60, in this Example, a 70 mm×50 mm×1.1 mm transparent conductive ITO glass substrate was used. A plurality of linear column electrodes 16 of 0.234 mm width were formed on the glass substrate at 0.02 mm intervals by etching. Similarly, as the rear substrate 14, a 70 mm×50 mm×1.1 mm ITO glass substrate was used. A plurality of linear row electrodes 17 of 0.234 mm width were formed on the glass substrate at 0.02 mm intervals by etching. Then, on the inner side surface of the display substrate 12 and the rear substrate 14 to be contacted with the particles, a transparent polycarbonate resin (PC-Z, produced by Mitsubishi Gas Chemical Company, Inc.) was coated to about 5 $\mu$m thickness so as to form a surface coating layer 18.

As the gap between the display substrate 12 and the rear substrate 14, a space formed by cutting out a central part of a 50 mm×50 mm×0.2 mm silicone rubber sheet in a 20 mm×20 mm square shape was provided as a gap member. This was disposed on the inner surface of the rear substrate 14 to be contacted with the particles.

As the colored particles, spherical the black particles 20 of carbon containing cross-linked polymethyl methacrylate with a 20 $\mu$m volume-average particle size (TECH POLYMER MBX-BLACK, produced by Sekisui Plastics Co., Ltd.) mixed in a 100 to 0.2 weight ratio with fine particles of AEROSIL A130 after an amino propyl trimethoxy silane treatment, and spherical white particles 22 of titanium oxide containing cross-linked polymethyl methacrylate of a 20 $\mu$m volume-average particle size (TECH POLYMER MBX-WHITE, produced by Sekisui Plastics Co., Ltd.) mixed in a 100 to 0.1 weight ratio with fine powder of titania after an isopropyl trimethoxy silane treatment, were used. These were mixed in a 3 to 5 weight ratio. At this time, by friction with each other, the black particles 20 were charged positively, and the white particles 22 were charged negatively.

About 18 mg of these mixed particles were sifted evenly through a screen into the square space cut out in the silicone rubber sheet 19 disposed on the rear substrate 14. Then, the display substrate 12 was superimposed on the rear substrate 14 via the silicone rubber sheet 19 such that the linear row electrodes 17 of the rear substrate 14 and the linear column electrodes 16 of the display substrate 12 were disposed orthogonally. The substrates were pressed and held by a double clip so as to closely contact the silicone rubber sheet 19 and the substrates, to provide the image display medium 60.

As shown in FIG. 1, the image display medium 60 produced as mentioned above had the column electrodes 16 of the display substrate 12 connected with the column electrode driving circuit 30 and the row electrodes 17 of the rear substrate 14 connected with the row electrode driving circuit 32. Then, vertical line and lateral line images produced by the image inputting device 38 were sent to the sequencer. By the sequencer 34 controlling the column electrode driving circuit 30 and the row electrode driving circuit 32, driving voltage was applied to the electrodes of each substrate so as to execute image display.

Figure 14:
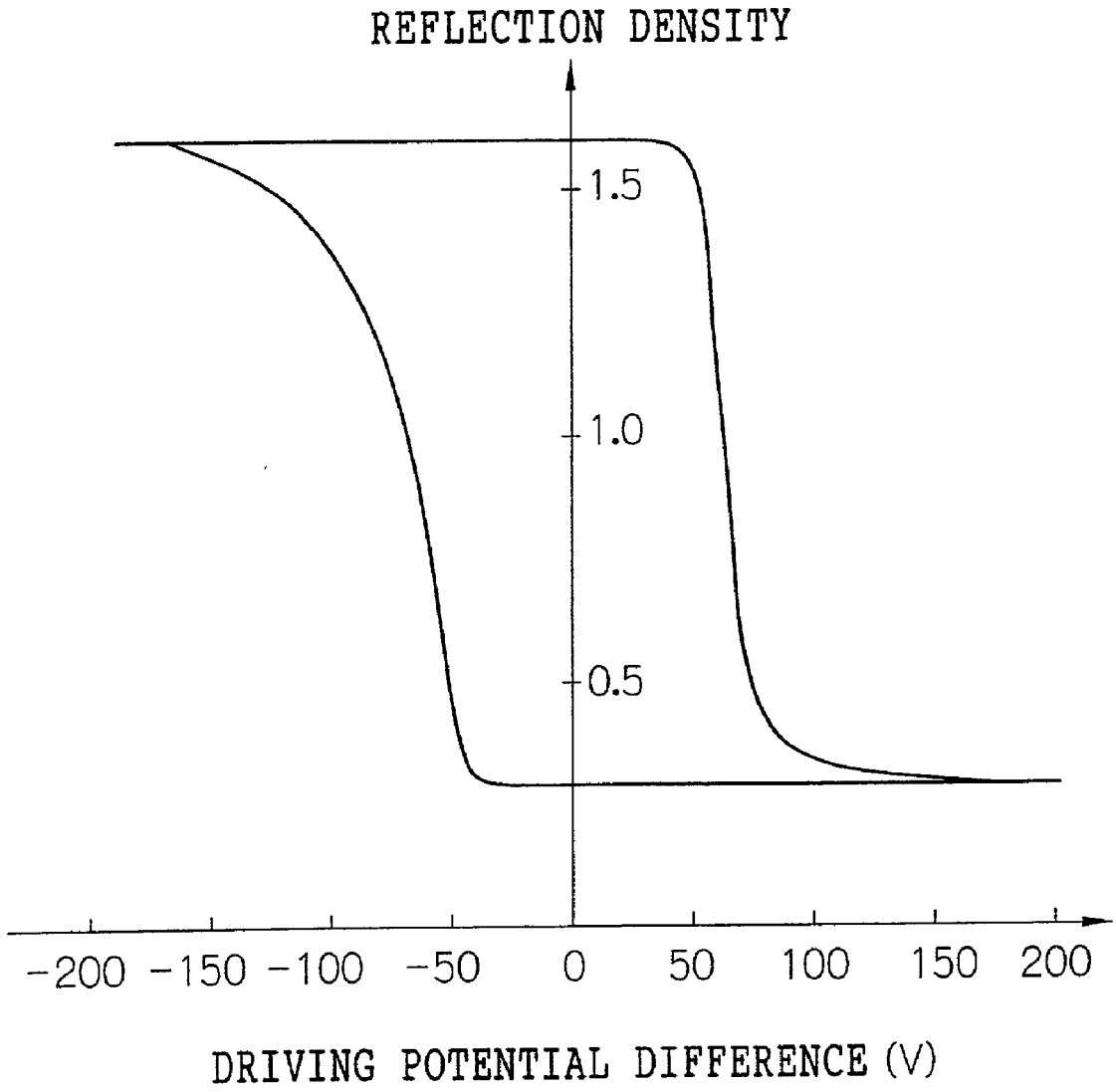
FIG. 14 is a graph showing the relationship between the potential difference to be applied between electrodes facing each other and the display density in the image display medium according to Example 1 of the present invention.

FIG. 14 shows the relationship between the driving potential difference and the display density (reflection density) in the image display medium 60 used in this example. Here, the driving potential difference is the value obtained by subtracting the voltage applied to the row electrode 17 of the rear substrate 14 from the voltage applied to the column electrode 16 of the display substrate 12. The display density was measured by a reflection density meter (X-RITE 404A, produced by X-Rite). Values of display density hereafter are values measured by the same reflection density meter.

The graph of FIG. 14 was obtained as follows. First, with all the row electrodes 17 of the rear substrate 14 set at 0 V constantly, +200 V was applied to all the column electrodes 16 of the display substrate 12 so as to have the white display on the entire display surface. Then, a 10 msec negative pulse voltage was applied to all the column electrodes 16 of the display substrate 12, and the display density was measured by the reflection density meter. Thereafter, 30 msec of a +200 V voltage was applied again to the electrodes of the display substrate 12 so as to have the display surface of the display substrate 12 in white. Next, while gradually changing the voltage value of the applied negative pulse voltage, the above-mentioned procedure was repeated. Similarly, −200 V was applied to all the column electrodes 16 of the display substrate 12 so as to have black display on the entire display surface of the display substrate. Then, a 10 msec positive pulse voltage was applied to all the column electrodes 16 of the display substrate 12, and the display density was measured by the reflection density meter. Thereafter, 30 msec of a −200 V voltage was applied again to the electrodes of the display substrate 12 so as to have the display surface in black. Next, while gradually changing the voltage value of the applied positive pulse voltage, the above-mentioned procedure was repeated.

As can be seen from FIG. 14, when executing the black display on the white display surface, the black display was not executed until about a −40 V potential difference between the column electrodes 16 of the display substrate 12 and the row electrodes 17 of the rear substrate 14. Similarly, when executing the white display on the black display surface, the white display was not executed until about +40 V.

Figure 15:
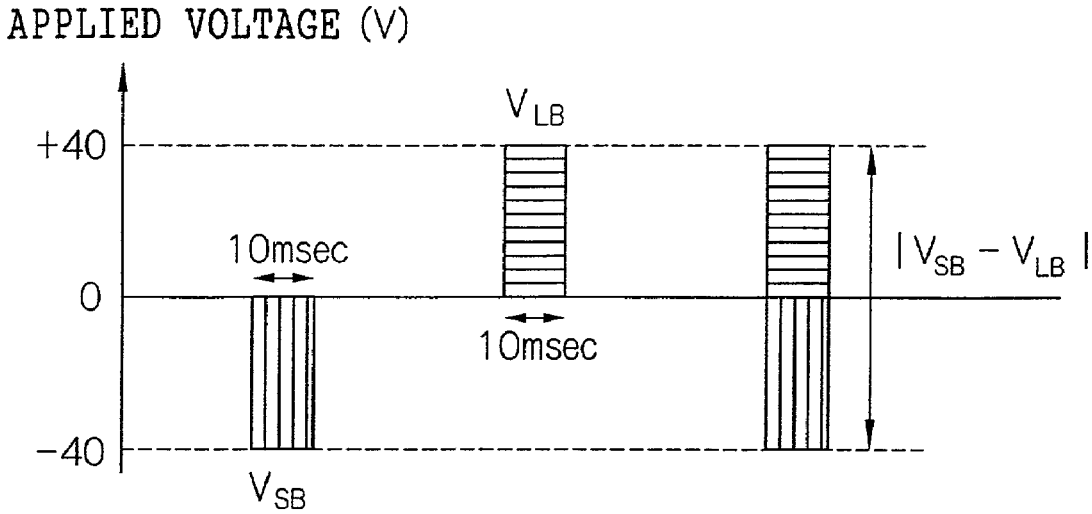
FIG. 15 is a graph showing the relationship between the voltage to be applied to the display substrate and the voltage to be applied to the rear substrate.

Next, a conventional driving method when displaying a black line image on the white display surface will be explained. As shown in FIG. 15, a −40 V pulse voltage was applied for 10 msec as the image writing voltage $V_{SB}$ to the column electrodes 16 of the display substrate 12, and a +40V pulse voltage was applied for 10 msec as the image writing voltage $V_{LB}$ to the row electrodes 17 of the rear substrate. Electrodes corresponding to the non-image part, that is, the column electrodes 16 of the display substrate 12 and the row electrodes 17 of the rear substrate 14 that were not to write the image were set at 0 V. The depictions at the left part of FIG. 15 are not chronological.

Therefore, with the direction from the rear substrate 14 side toward the display substrate 12 side being positive, at the image-writing pixels, a −80 V potential difference was applied, and a maximum −40 V potential difference was applied to the non-image-writing pixels. As shown in FIG. 14, since the black display was not executed from the white display state with the −40 V potential difference, even with the image writing voltage being applied to one of the column electrodes 16 of the display substrate 12 and the row electrodes 17 of the rear substrate 14, the image display was not executed. Only at the pixels with the image writing voltage applied to both was the black display executed to form the image.

An obtained vertical line image had a 0.27 mm line width and a line density of 1.14. Moreover, a lateral line image had a 0.54 mm line width and a line density of 1.02. Therefore, the targeted linear electrode width of 0.234 mm was substantially reproduced for the vertical line image. Moreover, for the line density, the equivalent density shown in the results of FIG. 14, 1.14 at the −80 V potential difference, was obtained. In contrast, in the lateral line image, the line width was spread significantly and the line density was deteriorated.

Figure 16:
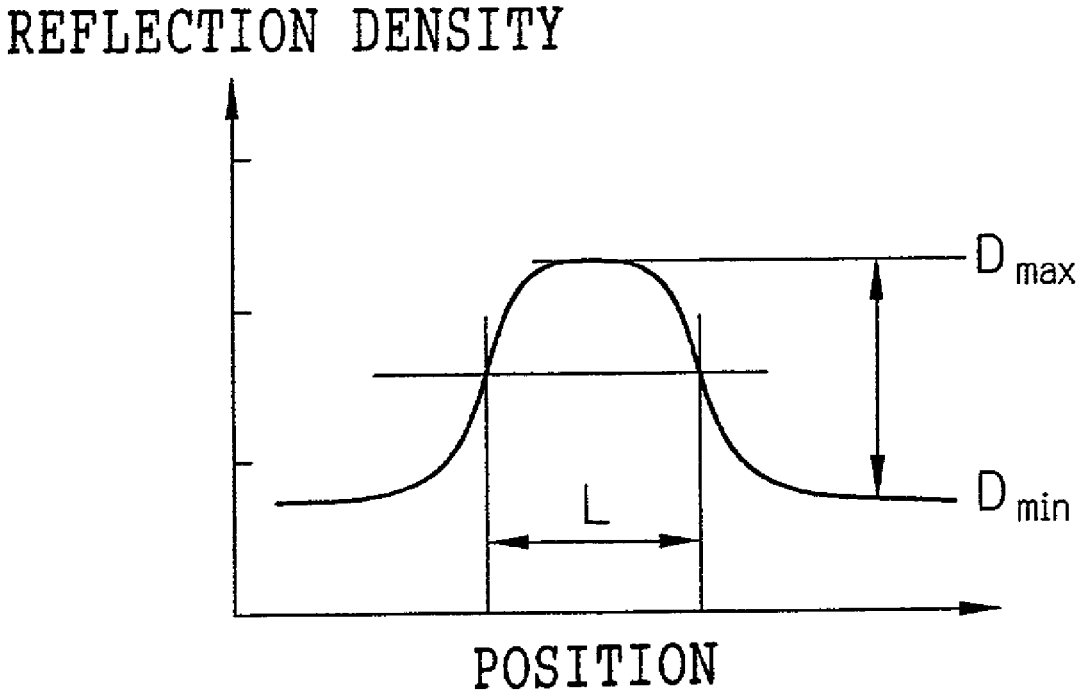
FIG. 16 is an explanatory diagram showing the relationship between image width (line width) and reflection density (line density).

Here, for measurement of the width and the density of the line image, an image enlarged by an optical microscope was taken by a CCD camera, and obtained optical strength data were converted to reflection density values to produce the image density profile shown in FIG. 16. The line width L was obtained from the median of the maximum density $D_{max}$ and the minimum density $D_{min}$, and the line density was obtained as the average density within the line width.

Figure 17:
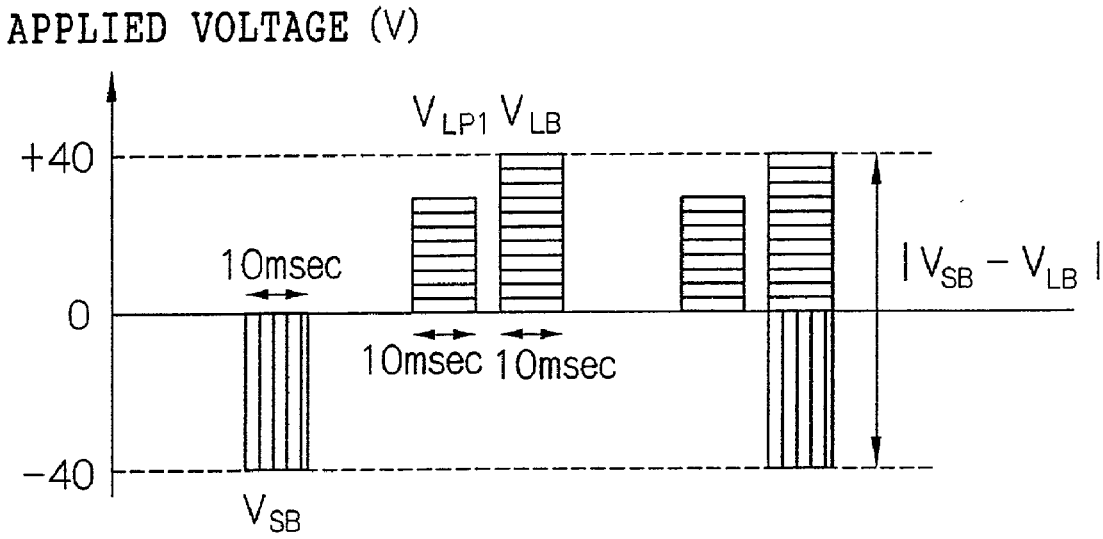
FIG. 17 is a graph showing the relationship between voltage to be applied to a display substrate and voltage to be applied to a rear substrate.

Next, a method for displaying the black line image on the white display surface will be explained. This is for moving and eliminating the particles in the vicinities between the image-writing row electrodes 17 of the rear substrate 14 and the row electrodes 17 adjacent thereto to the adjacent row electrode side, prior to display driving at the time of image display. In this example, as shown in FIG. 17, first, a +30 V pulse voltage $V_{LP1}$ was applied for 10 msec to the image-writing row electrodes 17 of the rear substrate 14. Thus, the particles in the vicinities between the image-writing row electrodes 17 of the rear substrate 14 and the row electrodes adjacent thereto were removed and moved to the adjacent row electrode side. The depiction on the left side of FIG. 17 is not chronological.

Thereafter, a −40 V pulse voltage was applied for 10 msec to the column electrodes 16 of the display substrate 12 as the image writing voltage $V_{SB}$, and a +40 V pulse voltage was applied for 10 msec to the row electrodes 17 of the rear substrate 14 as the image writing voltage $V_{LB}$, so as to execute the image display. The electrodes corresponding to the non-image part, that is, the column electrodes 16 of the display substrate 12 and the row electrodes 17 of the rear substrate 14 that were not to write the image, were set at 0 V.

The obtained vertical line image had a 0.26 mm line width and a 1.15 line density. Moreover, the lateral line image had a 0.43 mm line width and a 1.03 line density. Therefore, similarly to the case of the conventional driving method, the targeted linear electrode width was substantially reproduced for the vertical line image. Moreover, as the line density, the equivalent density shown in FIG. 14 was obtained. In contrast, for the lateral line image, although the line width was spread, the spread was reduced compared with the case of the conventional voltage applying method. Furthermore, the line density was substantially the same as that of the conventional voltage applying method.

Figure 18:
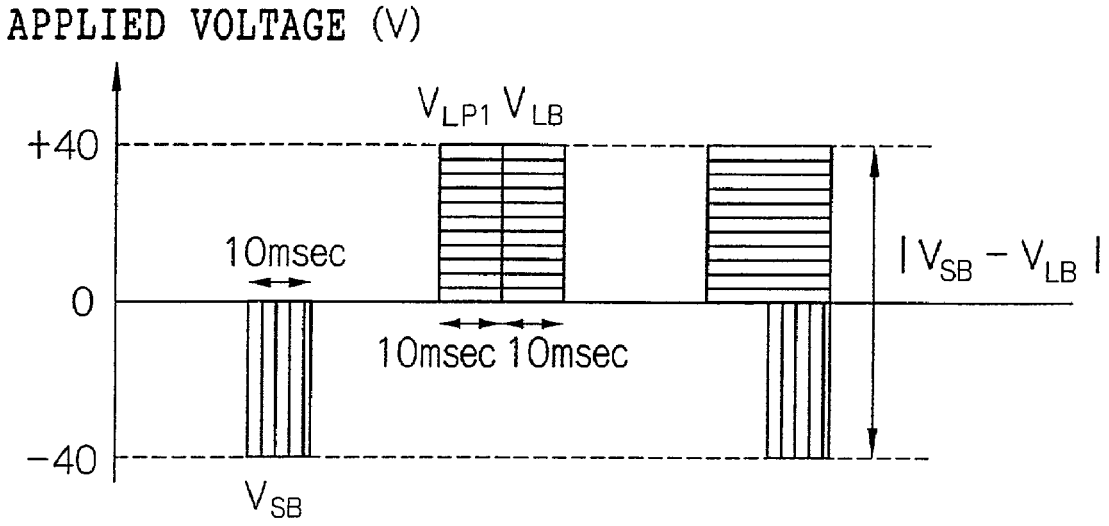
FIG. 18 is a graph showing the relationship between voltage to be applied to a display substrate and voltage to be applied to a rear substrate in Example 1 of the present invention.

As shown in FIG. 18, with the pulse voltage $V_{LP1}$ applied to the row electrodes 17 of the rear substrate 14 prior to the display drive at +40 V, the same as the voltage $V_{LB}$ to be applied at the time of display driving, the display driving was executed continuously. According to this method, since the timing of applying the display drive voltage $V_{LB}$ to the linear electrode 17 of the rear substrate 14 in the conventional simple matrix drive can be provided earlier than the timing of the display drive voltage $V_{SB}$ to be applied to the linear electrode 16 of the display substrate 12, a commonly used simple matrix driving controller can be used. Therefore, the characteristic of not generating any cost increase for the driving components when executing the driving method of the image display medium according to the present invention can be achieved. The depictions on the left side of FIG. 18 are not chronological.

The obtained vertical line image had a 0.26 mm line width and a 1.14 line density. Moreover, the lateral line image had a 0.41 mm line width and a 1.04 line density. Therefore, results the same as above were obtained.

EXAMPLE 2

In this Example, an example of the image display medium 10 according to the present invention will be explained. The image display device 10 was for driving the image display medium 60 by the simple matrix driving method. It was driven by a driving method different from that of Example 1. Since the image display medium and the driving device used in this example were the same as those of Example 1, explanation is not given therefor.

Figure 19:
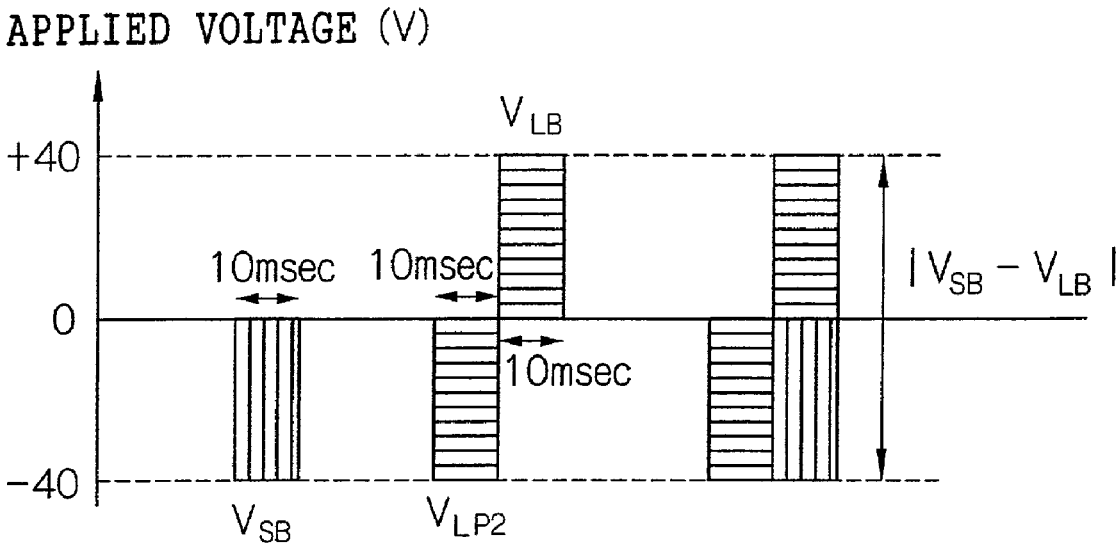
FIG. 19 is a graph showing the relationship between voltage to be applied to a display substrate and voltage to be applied to a rear substrate in Example 2 of the present invention.

In this Example, when displaying the black line image on the white display surface, prior to the display drive, the particles in the vicinities between the image-writing row electrodes 17 of the rear substrate 14 and the row electrodes adjacent thereto were removed and moved onto the image-writing row electrodes. In this Example, as shown in FIG. 19, first, a −40 V pulse voltage $V_{LP2}$ was applied for 10 msec to the image-writing row electrodes of the rear substrate 14, and the particles in the vicinities between the image-writing row electrodes 17 of the rear substrate 14 and the row electrodes adjacent thereto were moved to the image-writing row electrode side. The depictions on the left side of FIG. 19 are not chronological.

Thereafter, a −40 V pulse voltage was applied for 10 msec to the column electrodes 16 of the display substrate 12 as the image writing voltage $V_{SB}$, and a +40 V pulse voltage was applied for 10 msec to the row electrodes 17 of the rear substrate 14 as the image writing voltage $V_{LB}$ so as to execute the image display. Moreover, the electrodes corresponding to the non-image part, the non-image-writing column electrodes 16 of the display substrate 12 and row electrodes 17 of the rear substrate 14, were set at 0 V.

The obtained vertical line image had a 0.27 mm line width and a 1.18 line density. Moreover, the lateral line image had a 0.44 mm line width and a 1.07 line density. Therefore, for the vertical line, the targeted linear electrode width was substantially reproduced. Moreover, for the lateral line image, although the line width was spread, the spreading was reduced compared with the case of the conventional voltage applying method explained in Example 1. Furthermore, the line density was improved compared with that of the conventional voltage applying method.

EXAMPLE 3

In this Example, the cycle of applying the driving voltage of the image display media shown in FIGS. 15, 18 and 19 was repeated a plurality of times. Since the image display medium 60 and the driving device used in this Example were the same as those of Example 1, explanation is not given therefor.

First hereafter, the case of applying the driving voltage application cycle shown in FIG. 15 for displaying the black line image on the white display surface will be explained. In this example, a −40 V pulse voltage was applied for 10 msec to the column electrodes 16 of the display substrate 12 as the image writing voltage $V_{SB}$, and a +40 V pulse voltage was applied for 10 msec to the row electrodes 17 of the rear substrate 14 as the image writing voltage $V_{LB}$. Thereafter, after a 15 msec interval, the image writing voltage was applied again to the same column electrodes and row electrodes. This operation was repeated three times. The electrodes corresponding to the non-image part, the non-image-writing column electrodes 16 of the display substrate 12 and row electrodes 17 of the rear substrate 14, were set at 0 V.

As a result, an obtained vertical line image had a 0.27 mm line width and a 1.19 line density. Moreover, a lateral line image had a 0.57 mm line width and a 1.03 line density. Therefore, even though the density of the vertical line image was slightly improved, for the lateral line image this was not effective. On the contrary, the line width was slightly spread and edge disturbance was increased.

Next hereafter, the case of repeating the driving voltage application cycle shown in FIG. 18 for displaying the black line image on the white display surface will be explained. In this example, first, a +40 V pulse voltage was applied for 10 msec to the image-writing row electrodes of the rear substrate 14 as a preliminary voltage $V_{LP1}$. Immediately thereafter, a −40 V pulse voltage was applied for 10 msec to the column electrodes of the display substrate 12 as the image writing voltage $V_{SB}$, and a +40 V pulse voltage was applied for 10 msec to the row electrodes 17 of the rear substrate 14 as the image writing voltage $V_{LB}$. Thereafter, after a 15 msec interval, the image writing voltage was applied again to the same column electrodes and the row electrodes. This operation was repeated three times. The electrodes corresponding to the non-image part, the non-image-writing column electrodes 16 of the display substrate 12 and row electrodes 17 of the rear substrate 14, were set at 0 V.

As a result, an obtained vertical line image had a 0.27 mm line width and a 1.17 line density. Moreover, a lateral line image had a 0.41 mm line width and a 1.04 line density. Therefore, even though the density of the vertical line image was slightly improved, for the lateral line image density this was not effective. Furthermore, the lateral line width was not substantially changed even after repeating for a plurality of times, and edge disturbance was not observed.

Next hereafter, a case of repeating the driving voltage application cycle shown in FIG. 19 for displaying the black line image on the white display surface will be explained. In this example, first, a −40 V pulse voltage $V_{LP2}$ was applied for 10 msec to the image-writing row electrodes of the rear substrate 14. Immediately thereafter, a −40 V pulse voltage was applied for 10 msec to the column electrodes of the display substrate 12 as the image writing voltage $V_{SB}$, and a +40 V pulse voltage was applied for 10 msec to the row electrodes 17 of the rear substrate 14 as the image writing voltage $V_{LB}$. Thereafter, after a 15 msec interval, the image writing voltage was applied again to the same column electrodes and the row electrodes. This operation was repeated three times. The electrodes corresponding to the non-image part of the column electrodes 16 of the display substrate 12 and the row electrodes 17 of the rear substrate 14 not for writing the image were set at 0 V.

As a result, the obtained vertical line image had a 0.27 mm line width and a 1.21 line density. Moreover, the lateral line image had a 0.44 mm line width and a 1.12 line density. Therefore, this example was effective in terms of density improvement for the vertical line image and the lateral line image. Furthermore, the line width was not substantially changed even after the repeating for a plurality of times, and edge disturbance was not observed.

EXAMPLE 4

Figure 20:
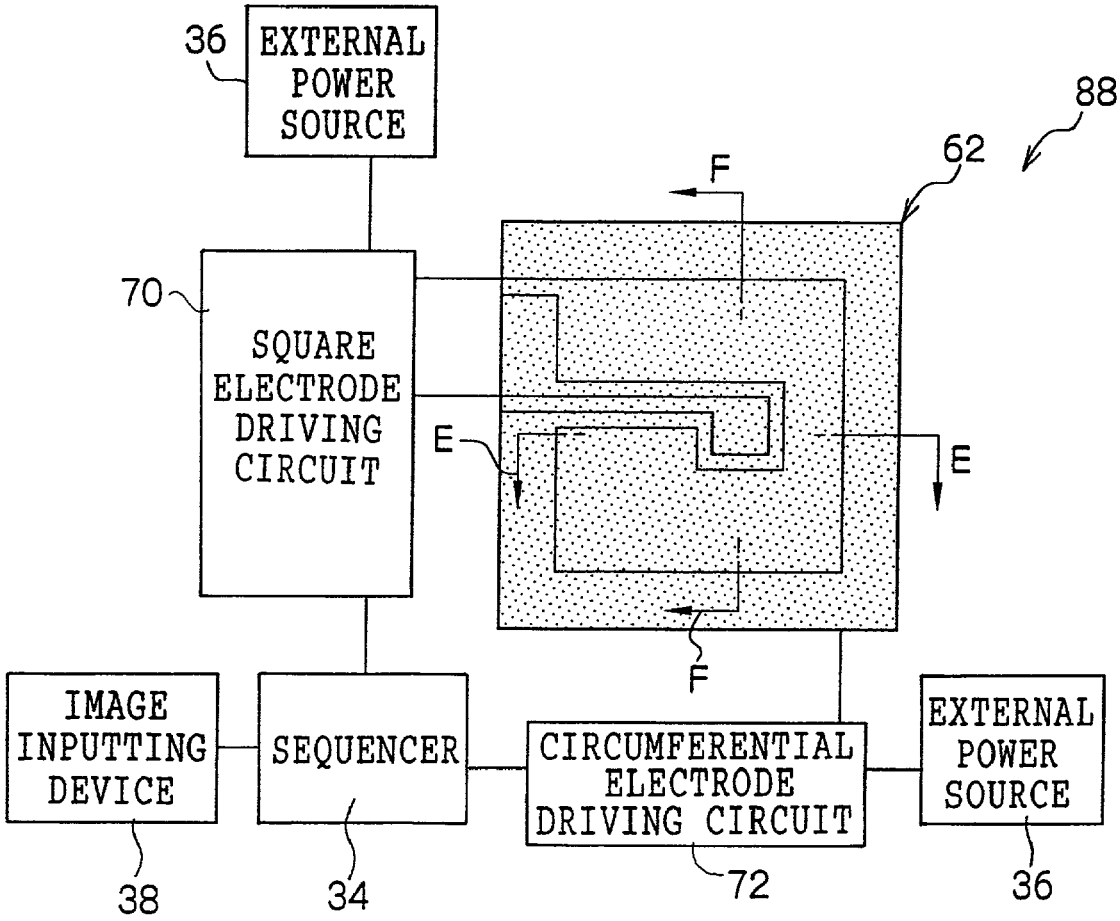
FIG. 20 is an explanatory diagram of an image display medium according to Example 4 of the present invention.
Figure 21:
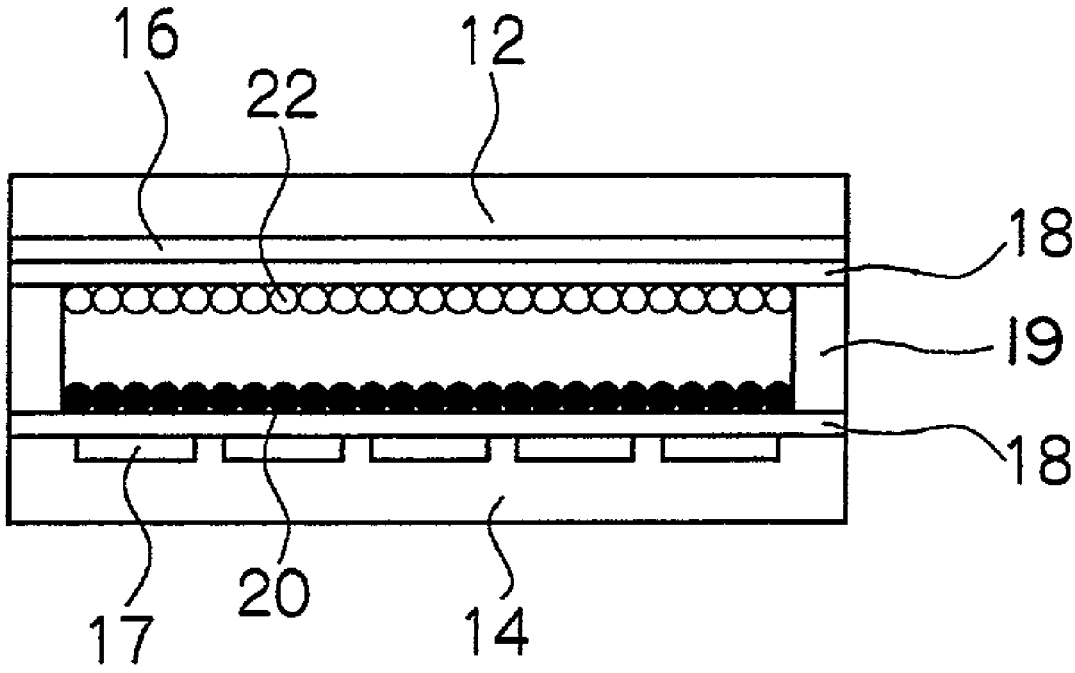
FIG. 21 is a cross-sectional view of the image display medium according to Example 4 of the present invention.

In this Example, an example of driving the image display device according to the present invention by the segment driving method and the active matrix driving method will be explained. The image display medium 62 of the segment driving method (pattern image display) used in this example is shown in FIGS. 20 to 22B. FIG. 20 shows an image display device 88 comprising the image display medium 62, and FIGS. 22A and 22B are front views of the display substrate 12 and the rear substrate 14.

Figure 22A:
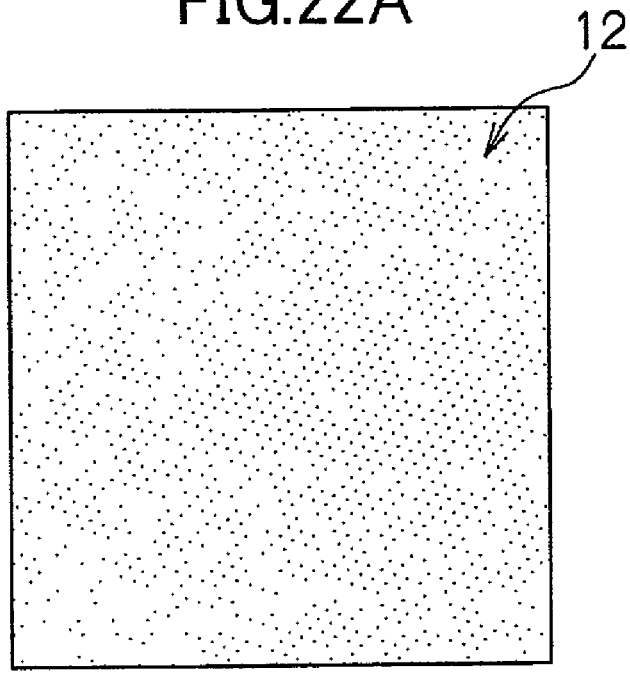
FIG. 22A is an explanatory diagram showing a display substrate of the image display medium according to Example 4 of the present invention.
Figure 22B:
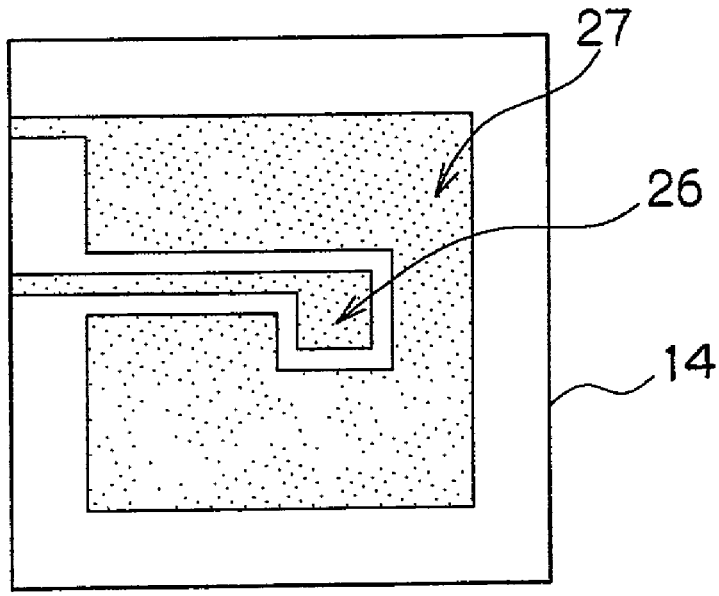
FIG. 22B is an explanatory diagram showing a rear substrate of the image display medium according to Example 4 of the present invention.

In this example, as the display substrate 12 for the image display medium 62, a 50 mm×50 mm×1.1 mm transparent conductive ITO glass substrate was used as the plane electrode 24 substrate (see FIG. 22A). Similarly, as the rear substrate 14, a 50 mm×50 mm×1.1 mm ITO glass substrate was used, and a square electrode 26 with 0.254 mm sides and a circumferential electrode 27 were formed on the glass substrate by etching (see FIG. 22B). The square electrode 26 was connected with a square electrode driving circuit 70 and the circumferential electrode 27 was connected with a circumferential electrode driving circuit 72.

From the square electrode 26, a lead line (0.03 mm width) for applying the voltage was taken, and the circumferential electrode 27 was formed with a 0.02 mm interval provided around the square electrode 24, including the lead line. Then, on the inner side surfaces of the display substrate 12 and the rear substrate 14 to be contacted with the particles, a transparent polycarbonate resin (PC-Z, produced by Mitsubishi Gas Chemical Company, Inc.) was coated to about 5 μm thickness so as to form a surface coating layer 18.

Since other configurations and the colored particles used were the same as those explained in Example 1, explanation is not given therefor.

The image display medium 62 used in this example used the segment driving method, with a desired pattern of electrodes formed on the rear substrate 14. However, the pattern electrode produced in this example had the same configuration as in the case of displaying a one dot image by active matrix drive, so the spreading of the pixels and the density reproductivity in the active matrix drive could be observed using the same.

First, the conventional driving method when displaying the black dot image on the white display surface will be explained. First, with the plane electrode 24 of the display substrate 12 at 0 V, a −200 V pulse voltage was applied for 30 msec to the square electrode 26 of the rear substrate 14 and the circumferential electrode 27 so as to have the entire display surface in white. Next, a +80 V pulse voltage was applied for 10 msec to the square electrode 26 of the rear substrate 14 as an image writing voltage $V_{AB}$ so as to form a black dot image. An obtained dot image had a 0.48 mm diameter and a 0.95 density, and was extremely blurred.

Here, for measurement of the diameter and the density of the dot image, an image enlarged by an optical microscope was taken by a CCD camera, and the obtained optical strength data were converted to reflection density values so as to produce the image density profile shown in FIG. 16 for each of an E—E cross-section and an F—F cross-section of the image display device shown in FIG. 20. The dot diameter was obtained as the diameter of a circle linking the median of the maximum density $D_{max}$ and the minimum density $D_{min}$ of the dot image, and the dot density was obtained as the average density within this circle.

Next, a method for displaying the black dot image on the white display surface according to the driving method of the image display medium of the present invention will be explained. In this driving method, prior to the display drive, the particles in the vicinity of the square electrode 26 of the rear substrate 14 and the circumferential electrode 27 were removed and moved to the circumferential electrode 27. In this example, first, after putting the display surface in the entire white display state, a +40 V pulse voltage $V_{AP1}$ was applied for 10 msec to the circumferential electrode 27 of the rear substrate 14. Thus, the particles between the square electrode 26 of the rear substrate 14 for writing the image and the circumferential electrode 27 adjacent thereto were removed and moved to the circumferential electrode 27 side. Thereafter, a +80 V pulse voltage was applied for 10 msec to the square electrode 26 of the rear substrate 14 as the image writing voltage $V_{AB}$ so as to execute the black dot display. At the time of executing the display drive, the plane electrode 24 of the display substrate 12 and the circumferential electrode 27 of the rear substrate 14 were set at 0 V.

The obtained dot image had a 0.39 mm diameter and a 0.96 density, and spreading of the dot was reduced compared with the conventional driving method. Moreover, the dot density was the same as in the conventional driving method.

EXAMPLE 5

In this Example, an example of the segment driving method and the active matrix driving method with the image display medium according to the present invention adopted will be explained. A driving method different from that of Example 4 was executed. Since the image display medium and the driving device used in this example were the same as those of Example 4, explanation is not given therefor.

In the driving method of the image display medium according to this example, prior to the display drive, the particles in the vicinity of the square electrode 26 of the rear substrate 14 and the circumferential electrode 27 were removed and moved to the square electrode 26 side. A case of displaying the black dot image on the white display surface according to the driving method of this example will be explained below.

In this example, first, after putting the display surface in the entire white display state, a −40 V pulse voltage $V_{AP2}$ was applied for 10 msec to the square electrode 26 of the rear substrate 14. Thus, the black particles 20 between the image-writing square electrode 26 of the rear substrate 14 and the circumferential electrode 27 adjacent thereto were moved onto the square electrode 26. Thereafter, a +80 V pulse voltage was applied for 10 msec to the square electrode 26 of the rear substrate 14 as the image writing voltage $V_{AB}$, so as to execute the black dot display. The plane electrode 24 of the display substrate 12 and the circumferential electrode 27 of the rear substrate 14 were set at 0 V.

The obtained dot image had a 0.41 mm diameter and a 1.05 density, and spreading of the dot was reduced compared with the conventional driving method. Moreover, the dot density was improved compared with the conventional driving method.

EXAMPLE 6

In this Example, the conventional driving method using the segment drive or the active matrix drive, and the driving methods according to the present invention described in Example 4 and Example 5 were repeatedly applied a plurality of times. Since the image display medium and the driving device used in this example were the same as those of Example 4, explanation is not given therefor.

First below, the case of displaying the black dot image on the white display surface by the conventional method of applying the driving voltage repeatedly will be explained. In this example, after putting the display surface in the entire white display state, a +80 V pulse voltage was applied for 10 msec to the square electrode 26 of the rear substrate 14 as the image writing voltage $V_{AB}$. Thereafter, after a 15 msec interval, the image writing voltage $V_{AB}$ was applied again to the square electrode 26 of the rear substrate 14. This operation was repeated three times. The plane electrode 24 of the display substrate 12 and the circumferential electrode 27 of the rear substrate 14 were set at 0 V.

The obtained dot image had a 0.52 mm diameter and a 0.98 density. Therefore, with the conventional driving method, even though the driving voltage was repeatedly applied a plurality of times, the dot density was only slightly improved. However, the spread of the dot was enlarged.

Next, the case of displaying the black dot image on the white display surface by the method of applying the driving voltage repeatedly according to the present invention will be explained. In this example, first, a +40 V pulse voltage $V_{AP1}$ was applied for 10 msec to the circumferential electrode 27 of the rear substrate 14 for moving and eliminating the particles in the vicinity between the square electrode 26 of the rear substrate 14 and the circumferential electrode 27 to the circumferential electrode 27 side. Immediately thereafter, a +80 V pulse voltage was applied for 10 msec as the image writing voltage $V_{AB}$ to the square electrode 26 of the rear substrate 14. Then, after a 15 msec interval, the image writing voltage $V_{AB}$ was applied again to the square electrode 26 of the rear substrate 14. This operation was repeated three times. At the time of executing the display drive, the plane electrode 24 of the display substrate 12 and the circumferential electrode 27 of the rear substrate 14 were set at 0 V.

The obtained dot image had a 0.40 mm diameter and a 0.98 density. Therefore, although spreading of the dot was restrained compared with the conventional driving method, an effect due to applying the driving voltage a plurality of times was not observed.

Next, another case of displaying the black dot image on the white display surface by the method of applying the driving voltage repeatedly according to the present invention will be explained. In this example, first, a −40 V pulse voltage $V_{AP2}$ was applied for 10 msec to the square electrode 26 of the rear substrate 14 for moving and eliminating the particles in the vicinity between the square electrode 26 of the rear substrate 14 and the circumferential electrode 27 onto the square electrode 26. Immediately thereafter, a +80 V pulse voltage was applied for 10 msec as the image writing voltage $V_{AB}$ to the square electrode 26 of the rear substrate 14. Then, after a 15 msec interval, the image writing voltage $V_{AB}$ was applied again to the square electrode 26 of the rear substrate 14. This operation was repeated three times. The plane electrode 24 of the display substrate 12 and the circumferential electrode 27 of the rear substrate 14 were set at 0 V.

The obtained dot image had a 0.40 mm diameter and a 1.11 density. Therefore, spreading of the dot was restrained compared with the conventional driving method, and the dot density was improved.

Hereinafter, colored particles and substrates usable in the above-mentioned embodiments and Examples will be explained.

First, examples of particles usable in the embodiments, in addition to the above-mentioned particles, include particles of insulating metal oxides such as glass beads, alumina and titanium oxide, thermoplastic or thermosetting resin particles, materials obtained by fixing a coloring agent on the surface of these resin particles, particles of a thermoplastic or thermosetting resin containing an insulating coloring agent, and the like.

Examples of thermoplastic resins usable for the production of the colored particles include single polymers or copolymers of styrenes, such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, vinyl ketones such as vinyl methyl ketone, vinyl hexyl ketone and vinyl isopropenyl ketone, and the like.

Moreover, examples of thermosetting resins usable for the production of the particles include cross-linked resins such as a cross-linked copolymer containing divinyl benzene as the main component and cross-linked polymethyl methacrylate, phenol resin, urea resin, melamine resin, polyester resin, silicone resin, and the like. In particular, as representative bonding resins, polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester, polyurethane, epoxy resin, silicone resin, polyamide, modified rosin, paraffin wax, and the like can be presented.

As the coloring agent, an organic or inorganic pigment, an oil-soluble dye, or the like can be used. Examples thereof include magnetic powders such as magnetite and ferrite, and known coloring agents such as carbon black, titanium oxide, magnesium oxide, zinc oxide, phthalocyanine copper based cyan color material, azo based yellow color material, azo based magenta color material, quinacridone based magenta color material, red color material, green color material and blue color material. Specifically, as representative examples, aniline blue, chalcoyl blue, chrome yellow, ultramarine blue, Dupont oil red, quinoline yellow, methylene blue chloride, phthalocyanine blue, malachite green oxalate, lamp black, rose bengal, C. I. pigment red 48:1, C. I. pigment red 122, C. I. pigment red 57:1, C. I. pigment yellow 97, C. I. pigment blue 15:1, C. I. pigment blue 15:3, and the like can be presented. Moreover, porous spongy particles and hollow particles containing air can be used as the white particles. These can be selected so as to have different tones for the two kinds of particles.

Although the shape of the colored particles is not particularly limited, spherical particles are preferable due to small physical adhesion force between the particles and the substrates and good particle flowability. For the formation of spherical particles, condensation polymerization, emulsion polymerization, dispersion polymerization, or the like can be used.

The primary particle diameters of the colored particles are generally 1 to 1000 $\mu$m, and preferably 5 to 50 $\mu$m, but are not limited thereto. In order to obtain a high contrast, it is preferable that the two kinds of particles have substantially the same particle size. Thus, a problem of large particles being surrounded by small particles so as to deteriorate the color density inherent to the large particles can be avoided.

As needed, an external additive may be adhered to the surface of the colored particles. By adhering the external additive, the charge characteristics of the colored particles can be controlled and the flowability can be improved. The color of the external additive is preferably white or transparent so as not to influence the particle color.

As the external additive, inorganic fine particles such as silicon oxide (silica), titanium oxide and alumina can be used. In order to adjust the charge property, the flowability, the environment dependency or the like of the fine particles, a surface treatment with a coupling agent or a silicone oil can be provided.

As the coupling agent, one with a positive charging property, such as an amino silane based coupling agent, an amino titanium based coupling agent or a nitrile based coupling agent, or one with a negative charging property, such as a silane based coupling agent not containing a nitrogen atom (i.e., comprising another atom instead of the nitrogen), a titanium based coupling agent, an epoxy silane coupling agent or an acrylic silane coupling agent can be used. Similarly, as the silicone oil, one with positive charge property, such as an amino modified silicone oil, or one with negative charge property, such as a dimethyl silicone oil, an alkyl modified silicone oil, an $\alpha$-methyl sulfone modified silicone oil, a methyl phenyl silicone oil, a chloro phenyl silicone oil or a fluorine modified silicone oil can be presented. These can be selected according to the desired resistance of the external additive.

Among these external additives, well-known hydrophobic silica and hydrophobic titanium oxide are preferable. In particular, a titanium compound obtained by the reaction of $TiO(OH)_2$ and a silane compound, such as a silane coupling agent as disclosed in the JP-A No. 10-3177, is preferable. As the silane compound, any of chlorosilane, alkoxysilane, silazane and a special silylating agent can be used. The titanium compound can be produced by reacting $TiO(OH)_2$ produced in a wet process with a silane compound or a silicone oil, and drying. Since a baking step at several hundred degrees is not needed, a strong bond is not formed among the Ti, so the fine particles can be substantially in the primary particle state without any aggregation. Furthermore, since the $TiO(OH)_2$ is reacted directly with the silane compound or the silicone oil, the processing amount of the silane compound or the silicone oil can be made larger, the charge characteristic can be controlled by adjusting the processing amount of the silane compound or the like, and the charge ability to be provided can be remarkably improved compared with conventional titanium oxide.

The primary particles of the external additive are generally 5 to 100 nm, and preferably 10 to 50 nm, but are not limited thereto.

The composition ratio of the external additive and the particles can be adjusted optionally in view of the particle size of the particles and the particle size of the external additive. If the amount of the external additive is too large, a part of the external additive will be liberated from the particle surface and will adhere on the surface of the other particles so that a desired charge characteristic may not be obtained. In general, the amount of the external additive is 0.01 to 3 parts by weight, more preferably 0.05 to 1 part by weight with respect to 100 parts by weight of the particles.

The composition of the particles to be combined, the mixing ratio of the particles, presence or absence of the external additive, the composition of the external additive, and the like can be selected to obtain desired charge characteristics.

The external additive may be added either to only one of the two kinds of the particles or to both. If the external additive is added to both particles, it is preferable to use external additives of different polarities. Moreover, if the external additive is added to the surfaces of both particles, it is preferable that the external additive is fixed firmly on the particle surface by pushing the external additive onto the particle surface by an impact force or by heating the particle surface. Thus, the problem of liberation of the external additive from the particles, such that the external additives of different polarities are firmly aggregated and form aggregates of the external agents that are hard to separate by electric fields, can be prevented and, consequently, image quality deterioration can be prevented.

The contrast depends on the particle size of the two kinds of the particles, and furthermore also depends on the mixing ratio of the particles. In order to obtain a high contrast, it is preferable to determine the mixing ratio so as to have substantially the same surface area for the two kinds of the particles. If the ratio drastically deviates therefrom, the color of the particles with the larger ratio will be emphasized. However, when providing tones of the two kinds of the particles in a thicker tone and a thinner tone of the same color, or utilizing a color produced by mixing the two kinds of the particles, this limitation need not apply.

Next, examples of substrates usable in the embodiments, in addition to the above-mentioned substrate, include one comprising a common supporting base member and an electrode. Examples of the supporting base member include glass and plastics, such as polycarbonate resin, acrylic resin, polyimide resin, polyester resin, and epoxy resin. Moreover, as the electrodes, oxides such as oxides of indium, tin, cadmium and antimony, composite oxides such as ITO, metals such as gold, silver, copper and nickel, organic conductive materials such as polypyrrol and polythiophene, and the like can be used. These can be used as a single layer film, a mixture film or a composite film, and they can be formed by a deposition method, sputtering method, coating method, or the like. Moreover, the thickness thereof is generally 100 to 2,000 angstrom in the deposition method or sputtering method. The electrodes can be formed by conventionally known means such as etching of a conventional liquid crystal display element or printed board into a desired pattern, for example, a matrix form.

Moreover, the electrodes may be embedded in the supporting base member. In this case, since the material of the supporting base member serves also as the dielectric layer, described later, so as to possibly influence the charge characteristics or the flowability of the particles, the material is selected optionally according to the composition of the particles, or the like.

Furthermore, the electrodes may be separated from the substrate and disposed outside the display medium. In this case, since the display medium is interposed between the electrodes, the distance between the electrodes is made larger, which makes the electric field intensity smaller. Thus, a technique is required for obtaining a desired electric field intensity, for example, by reducing the substrate thickness of the display medium and the distance between the substrates, or the like.

If the electrodes are formed on the supporting base member, in order to prevent leakage between the electrodes, which may result in breakage of the electrodes or fixation of the particles, a dielectric film may be formed on the electrodes as needed. As the dielectric film, polycarbonate, polyester, polystyrene, polyimide, epoxy, polyisocyanate, polyamide, polyvinyl alcohol, polybutadiene, polymethyl methacrylate, copolymer nylon, ultraviolet ray hardening acrylic resin, fluorine resin, or the like can be used.

Moreover, in addition to the above-mentioned insulating materials, insulating materials containing a charge transporting substance can be used. By including the charge transporting substance, effects of improving the particle charge characteristic by injection of charge into the particles, stabilizing the charge amount of the particles by leakage of the charge of the particles when the particle charge amount becomes extremely large, and the like can be obtained. As the charge transporting substance, for example, a positive hole transporting substance such as a hydrazone compound, a stylbene compound, a pyrazoline compound, an aryl amine compound, or the like can be presented. Moreover, an electron transporting substance such as a fluorenone compound, a diphenoquinone derivative, a pyran compound, a zinc oxide, or the like can be used as well. Furthermore, a self supporting type resin having the charge transporting property can be used. Specific examples include polyvinyl carbazol, a polycarbonate obtained by polymerization of a specific dihydroxy aryl amine and a bischloroformate disclosed in U.S. Pat. No. 4,806,443, and the like.

Since the dielectric film influences the charge characteristics and the flowability of the particles, it is selected optionally according to the composition of the colored particles or the like. Since one of the substrates, the display substrate 12, needs to transmit light, it is preferable to use a transparent one of the above-mentioned materials therefor.

As heretofore explained, according to the present invention, even when displaying an image of high resolution, an excellent effect of providing an image display device capable of preventing deterioration of display quality by preventing deterioration of display sharpness and display contrast, by preliminarily controlling movement of particles in directions parallel to a display substrate, can be provided.

What is claimed is:

1. An image display device comprising:

an image display medium with an image display surface, the image display medium including a display substrate at the image display surface side, the display substrate including a first electrode, a rear substrate facing the display substrate, the rear substrate including a plane surface and a plurality of second electrodes arranged on the plane surface at predetermined intervals, at least two kinds of particles including different colors and charge characteristic, the particles being sealed between the display substrate and the rear substrate, and being movable between the first electrode and the second electrodes when an electric field is generated between the first electrode and the second electrodes by application of a display drive voltage for executing image display; and a voltage applying component which, before the application of the display drive voltage, applies voltage so as to generate an electric field capable of moving the particles that are disposed between adjacent the second electrodes.

2. The image display device of claim 1, wherein the first electrode of the image display medium comprises an electrode group including a plurality of substantially parallel linear electrodes respectively corresponding to one of rows and columns, the plurality of second electrodes comprises an electrode group including a plurality of substantially parallel linear electrodes respectively corresponding to the other of rows and columns, the first electrodes and the second electrodes being arranged in a simple matrix pattern so as to intersect each other in plan view, and the voltage applying component applies the voltage before the application of the display drive voltage so as to generate an electric field capable of moving particles that are disposed between the lines of the second electrodes.

3. The image display device of claim 1, wherein at least the plurality of second electrodes of the image display medium comprises an electrode group forming an active matrix pattern, the electrode group including a plurality of electrodes respectively corresponding to pixels of the active matrix pattern, and the voltage applying component applies the voltage before the application of the display drive voltage so as to generate an electric field capable of moving particles that are disposed between the individual electrodes forming the electrode group.

4. The image display device of claim 1, wherein the voltage applying component applies the voltage before the application of the display drive voltage to the second electrodes so as to generate an electric field capable of moving particles at the rear substrate in a direction from an electrode corresponding to a pixel that executes the image display towards an electrode adjacent thereto.

5. The image display device of claim 1, wherein the voltage applying component applies the voltage before the application of the display drive voltage to the second electrodes so as to generate an electric field capable of moving particles at the rear substrate in a direction from an end portion of an electrode corresponding to a pixel that executes the image display towards an electrode adjacent thereto.

6. The image display device of claim 1, wherein the voltage applying component applies the voltage before the application of the display drive voltage to the second electrodes so as to generate an electric field capable of moving particles at the rear substrate in a direction towards an electrode corresponding to a pixel that executes the image display from an electrode adjacent thereto.

7. The image display device of claim 1, wherein the voltage applying component applies the voltage before the application of the display drive voltage to the second electrodes so as to generate an electric field capable of moving particles at the rear substrate in a direction towards an electrode corresponding to a pixel that executes the image display from an end portion of an electrode adjacent thereto.

8. The image display device of claim 1, wherein the voltage applying component applies the display drive voltage for executing image display a plurality of times.

9. The image display device of claim 1, wherein the voltage that generates an electric field capable of moving particles that are disposed between adjacent the second electrodes before the application of the display drive voltage to the second electrodes comprises a voltage value substantially the same as a voltage value of the display drive voltage.

10. The image display device of claim 1, wherein at least the plurality of second electrodes of the image display medium comprises an electrode group including a fine electrode pattern that forms a segment pattern, and the voltage applying component applies the voltage before the application of the display drive voltage so as to generate an electric field capable of moving particles that are disposed between the individual electrodes forming the electrode group.

11. An image display device comprising:

an image display medium with an image display surface, the image display medium including a display substrate at the image display surface side, the display substrate including a first electrode, a rear substrate facing the display substrate, the rear substrate including a plane surface and a plurality of second electrodes arranged on the plane surface at predetermined intervals, at least two kinds of particles including different colors and charge characteristic, the particles being sealed between the display substrate and the rear substrate, and being movable between the first electrode and the second electrodes when an electric field is generated between the first electrode and the second electrodes by application of a display drive voltage for executing image display; and a voltage applying component which applies a voltage to the second electrodes so as to generate an electric field capable of moving the particles at the rear substrate in a direction from an electrode corresponding to a pixel that executes image display substantially only towards an electrode adjacent thereto, and thereafter applies a display drive voltage for executing the image display to the first and second electrodes.

12. The image display device of claim 11, wherein the first electrode of the image display medium comprises an electrode group including a plurality of substantially parallel linear electrodes respectively corresponding to one of rows and columns, and the plurality of second electrodes comprises an electrode group including a plurality of substantially parallel linear electrodes respectively corresponding to the other of rows and columns, the first electrodes and the second electrodes being arranged in a simple matrix pattern so as to intersect each other in plan view.

13. The image display device of claim 11, wherein at least the plurality of second electrodes of the image display medium comprises an electrode group forming an active matrix pattern, the electrode group including a plurality of electrodes respectively corresponding to pixels of the active matrix pattern.

14. The image display device of claim 11, wherein the voltage applying component applies the display drive voltage for executing image display a plurality of times.

15. The image display device of claim 11, wherein at least the plurality of second electrodes of the image display medium comprises a fine electrode pattern that forms a segment pattern.

16. An image display device comprising:

an image display medium with an image display surface, the image display medium including a display substrate at the image display surface side, the display substrate including a first electrode, a rear substrate facing the display substrate, the rear substrate including a plane surface and a plurality of second electrodes arranged on the plane surface at predetermined intervals, at least two kinds of particles including different colors and charge characteristics, the particles being sealed between the display substrate and the rear substrate, and being movable between the first electrode and the second electrodes when an electric field is generated between the first electrode and the second electrodes by application of a display drive voltage for executing image display; and a voltage applying component which applies a voltage to the second electrodes so as to generate an electric field capable of moving the particles at the rear substrate in a direction substantially only towards an electrode corresponding to a pixel that executes image display from an electrode adjacent thereto, and thereafter applies a display drive voltage for executing the image display to the first and second electrodes.

17. The image display device of claim 16, wherein the first electrode of the image display medium comprises an electrode group including a plurality of substantially parallel linear electrodes respectively corresponding to one of rows and columns, and the plurality of second electrodes comprises an electrode group including a plurality of substantially parallel linear electrodes respectively corresponding to the other of rows and columns, the first electrodes and the second electrodes being arranged in a simple matrix pattern so as to intersect each other in plan view.

18. The image display device of claim 16, wherein at least the plurality of second electrodes of the image display medium comprises an electrode group forming an active matrix pattern, the electrode group including a plurality of electrodes respectively corresponding to pixels of the active matrix pattern.

19. The image display device of claim 16, wherein the voltage applying component applies the display drive voltage for executing image display a plurality of times.

20. The image display device of claim 16, wherein at least the plurality of second electrodes of the image display medium comprises a fine electrode pattern that forms a segment pattern.

* * * * *